US010188204B2

(12) United States Patent
Atkins

(10) Patent No.: US 10,188,204 B2
(45) Date of Patent: Jan. 29, 2019

(54) DESK WITH STABILITY FEATURE

(71) Applicant: Argosy Console, Inc., Eldon, MO (US)

(72) Inventor: William David Atkins, Osage Beach, MO (US)

(73) Assignee: Argosy Console, Inc., Eldon, MO (US)

( * ) Notice: Subject to any disclaimer, the term of this patent is extended or adjusted under 35 U.S.C. 154(b) by 0 days.

(21) Appl. No.: 15/920,070

(22) Filed: Mar. 13, 2018

(65) Prior Publication Data

US 2018/0199705 A1 Jul. 19, 2018

Related U.S. Application Data

(60) Provisional application No. 62/471,355, filed on Mar. 14, 2017.

(51) Int. Cl.

| | |
|---|---|
| ***A47B 9/02*** | (2006.01) |
| ***G10G 5/00*** | (2006.01) |
| ***A47B 9/20*** | (2006.01) |
| *A47B 21/02* | (2006.01) |

(52) U.S. Cl.

CPC ..... *A47B 9/02* (2013.01); *A47B 9/20* (2013.01); *G10G 5/00* (2013.01); *A47B 21/02* (2013.01)

(58) Field of Classification Search

CPC .... A47B 9/02; A47B 9/10; A47B 9/20; A47C 3/30

USPC ..... 108/147, 147.19, 133, 129, 132, 115; 248/188.2, 188.5, 421, 422

See application file for complete search history.

(56) References Cited

U.S. PATENT DOCUMENTS

| | | | | | |
|---|---|---|---|---|---|
| 1,757,260 | A | * | 5/1930 | Silverman | A47B 3/0913 108/132 |
| 3,101,062 | A | | 8/1963 | Kanzelberger | |
| 3,305,876 | A | * | 2/1967 | Hutt | A61G 7/012 108/147 |
| 4,026,221 | A | * | 5/1977 | Wilson | A47B 3/087 108/169 |
| 4,596,196 | A | | 6/1986 | Gunter et al. | |
| 4,711,184 | A | * | 12/1987 | Wallin | A47B 9/10 108/147 |
| 5,197,393 | A | | 3/1993 | Yeakle | |
| 5,535,466 | A | | 7/1996 | Snell | |
| 5,657,498 | A | * | 8/1997 | Hum | A47B 9/16 108/147 |

(Continued)

FOREIGN PATENT DOCUMENTS

| | | |
|---|---|---|
| CN | 201243766 | 5/2009 |
| CN | 204561316 | 8/2015 |

(Continued)

OTHER PUBLICATIONS varidesk.com; website for ProDesk 48" Black desk, located at <https://web.archive.org/web/20170405183154/https://www.varidesk.com/products/full-standing-desk-pro-desk>, publicly available as early as Apr. 15, 2017, 4 pgs.

(Continued)

*Primary Examiner* — Jose V Chen

(74) *Attorney, Agent, or Firm* — Taylor English Duma LLP

(57) ABSTRACT

A desk includes a desktop at a top end; a leg including an attachment portion and a foot portion, the attachment portion of the leg secured to the desktop and extending away from the desktop, the foot portion of the leg defining a bottom end of the desk; and a gas spring connecting the leg to the desktop.

20 Claims, 19 Drawing Sheets

(56) References Cited

U.S. PATENT DOCUMENTS

| | | | | | |
|---|---|---|---|---|---|
| 5,682,825 | A * | 11/1997 | Manner | A47B 9/02 | 108/144.11 |
| 5,743,193 | A * | 4/1998 | Kakuta | A47B 21/02 | 108/106 |
| 5,758,849 | A * | 6/1998 | Bui | A47B 9/10 | 108/145 |
| 5,810,320 | A * | 9/1998 | Claesson | A47B 9/02 | 108/147 |
| 5,823,120 | A | 10/1998 | Holmquist | | |
| 6,354,227 | B1 * | 3/2002 | Feldpausch | A47B 37/02 | 108/10 |
| 6,443,075 | B1 * | 9/2002 | Hahn | A47B 9/02 | 108/147 |
| 6,474,246 | B2 * | 11/2002 | Hsu | A47B 9/04 | 108/147 |
| 6,609,465 | B2 | 8/2003 | Kolavo | | |
| 6,644,216 | B1 | 11/2003 | Cole | | |
| 6,820,562 | B2 * | 11/2004 | Zodnik | A47B 7/02 | 108/50.01 |
| 6,920,833 | B2 * | 7/2005 | Lou-Hao | A47B 3/091 | 108/132 |
| 7,220,185 | B2 | 5/2007 | Chen | | |
| 7,412,931 | B2 * | 8/2008 | Seidl | A47B 9/02 | 108/147 |
| 2003/0033963 | A1 * | 2/2003 | Doyle | A47B 9/04 | 108/147.19 |
| 2004/0211344 | A1 | 10/2004 | Lor | | |
| 2011/0141672 | A1 | 6/2011 | Farley, Jr. et al. | | |
| 2013/0014675 | A1 * | 1/2013 | Burkhalter | A47B 7/02 | 108/50.11 |
| 2017/0156488 | A1 * | 6/2017 | Ergun | A47B 9/02 | |
| 2018/0055214 | A1 * | 3/2018 | Kim | A47B 9/16 | |
| 2018/0199704 | A1 | 7/2018 | Atkins | | |

FOREIGN PATENT DOCUMENTS

| | | |
|---|---|---|
| KR | 200440214 | 5/2008 |
| KR | 2020120003306 | 5/2012 |
| WO | 1991017906 | 11/1991 |
| WO | 2018170012 | 9/2018 |

OTHER PUBLICATIONS varidesk.com; website for ProDesk 60" Darkwood desk, located at <https://web.archive.org/web/20170517080232/https://www.varidesk.com/products/full-standing-desk-pro-desk?o=Size%3A60+inch%3BColor%3ADarkwood >, publicly available as early as May 17, 2017, 4 pgs.

Atkins, William David; International Search Report for PCT Application No. PCT/US18/22255, filed Mar. 13, 2018, dated Jun. 1, 2018, 8 pgs.

* cited by examiner

DESK WITH STABILITY FEATURE

REFERENCE TO RELATED APPLICATIONS

This application claims the benefit of U.S. Provisional Application No. 62/471,355, filed Mar. 14, 2017, which is hereby specifically incorporated by reference herein in its entirety.

TECHNICAL FIELD

Field of Use

This disclosure relates to desks. More specifically, this disclosure relates to adjustable sit-stand desks with a stability feature.

Related Art

A desk that allows a user to stand while working, or that allows the user to alternate between sitting and standing postures throughout the day, can provide a variety of health, productivity, and other benefits. Commonly referred to as a "standing desk," a "sit-to-stand" desk, a "stand up" desk, a "sit-stand" desk, or a workstation, such a piece of furniture, while yielding these benefits, can at the same time be significantly more unstable than a desk behind which the user would merely sit. Such instability can result from the center of gravity of such a desk being significantly higher off the floor and from the inherent looseness in the moving parts of an adjustable version of such a desk. Loading the desk with heavy objects or with impact forces sufficient to jar the desktop can further impact stability.

SUMMARY

It is to be understood that this summary is not an extensive overview of the disclosure. This summary is exemplary and not restrictive, and it is intended to neither identify key or critical elements of the disclosure nor delineate the scope thereof. The sole purpose of this summary is to explain and exemplify certain concepts of the disclosure as an introduction to the following complete and extensive detailed description.

In one aspect, disclosed is a desk comprising: a desktop at a top end; a leg comprising an attachment portion and a foot portion, the attachment portion of the leg secured to the desktop and extending away from the desktop, the foot portion of the leg defining a bottom end of the desk; and a gas spring connecting the leg to the desktop.

In a further aspect, disclosed is a method of using a desk comprising: securing a gas spring to a desktop of the desk and a leg of the desk; and raising the desktop from a lower position to an upper position located above the lower position.

In another aspect, disclosed is a desk comprising: a desktop; a leg comprising an attachment portion and a foot portion, the attachment portion of the leg secured to the desktop and extending away from the desktop, the attachment portion of the leg configured to move with respect to the foot portion of the leg along an axis of the leg to adjust a height of the desktop about and between a lower position and an upper position, the foot portion of the leg defining a bottom end of the desk; and a gas spring extending from the leg to the desktop, the gas spring angled with respect to the leg by a non-90-degree angle and with respect to the desktop by a non-90-degree angle.

In another aspect, disclosed is a desk comprising: a desktop; a leg comprising an attachment portion and a foot portion, the attachment portion of the leg secured to the desktop and extending away from the desktop, the foot portion of the leg defining a bottom end of the desk, a position of the desktop fixed with respect to the foot portion of the leg; and a gas spring connecting the leg to the desktop, the gas spring angled with respect to the leg by a non-90-degree angle and with respect to the desktop by a non-90-degree angle.

In another aspect, disclosed is a method of assembling a desk, the method comprising: attaching a first joint of a gas spring to an attachment point on a desktop; and attaching a second joint of the gas spring to an attachment point on a leg, the leg secured to the desktop and extending away from the desktop, the leg comprising an attachment portion and a foot portion, the foot portion of the leg defining a bottom end of the desk; wherein after attaching the gas spring to the desktop and to the leg, the gas spring is angled with respect to the leg by a non-90-degree angle and with respect to the desktop by a non-90-degree angle.

In another aspect, disclosed is a desk comprising: a desktop; a leg comprising an attachment portion and a foot portion, the attachment portion of the leg secured to the desktop and extending away from the desktop, the attachment portion of the leg configured to move with respect to the foot portion of the leg along an axis of the leg to adjust a height of the desktop about and between a lower position and an upper position, the foot portion of the leg defining a bottom end of the desk; and a gas spring extending from the leg to the desktop, the gas spring angled with respect to the leg by an angle of at least 5 degrees and with respect to the desktop by an angle of at least 5 degrees.

In another aspect, disclosed is a desk comprising: a desktop; a leg comprising an attachment portion and a foot portion, the attachment portion of the leg secured to the desktop and extending away from the desktop, the foot portion of the leg defining a bottom end of the desk, a position of the desktop fixed with respect to a foot portion of the leg; and a gas spring connecting the leg to the desktop, the gas spring angled with respect to the leg by an angle of at least 5 degrees and with respect to the desktop by an angle of at least 5 degrees.

In another aspect, disclosed is a method of assembling a desk, the method comprising: attaching a first joint of a gas spring of the desk to an attachment point on a desktop; and attaching a second joint of the gas spring to an attachment point on a leg, the leg secured to the desktop and extending away from the desktop, the leg comprising an attachment portion and a foot portion, the foot portion of the leg defining a bottom end of the desk; wherein after attaching the gas spring to the desktop and to the leg the gas spring is angled with respect to the leg by an angle of at least 5 degrees and with respect to the desktop by an angle of at least 5 degrees.

Various implementations described in the present disclosure may comprise additional systems, methods, features, and advantages, which may not necessarily be expressly disclosed herein but will be apparent to one of ordinary skill in the art upon examination of the following detailed description and accompanying drawings. It is intended that all such systems, methods, features, and advantages be included within the present disclosure and protected by the accompanying claims. The features and advantages of such implementations may be realized and obtained by means of the systems, methods, features particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

The accompanying drawings, which are incorporated in and constitute a part of this specification, illustrate several aspects of the disclosure and together with the description, serve to explain various principles of the disclosure. The drawings are not necessarily drawn to scale. Corresponding features and components throughout the figures may be designated by matching reference characters for the sake of consistency and clarity.

DETAILED DESCRIPTION

Figure 1:
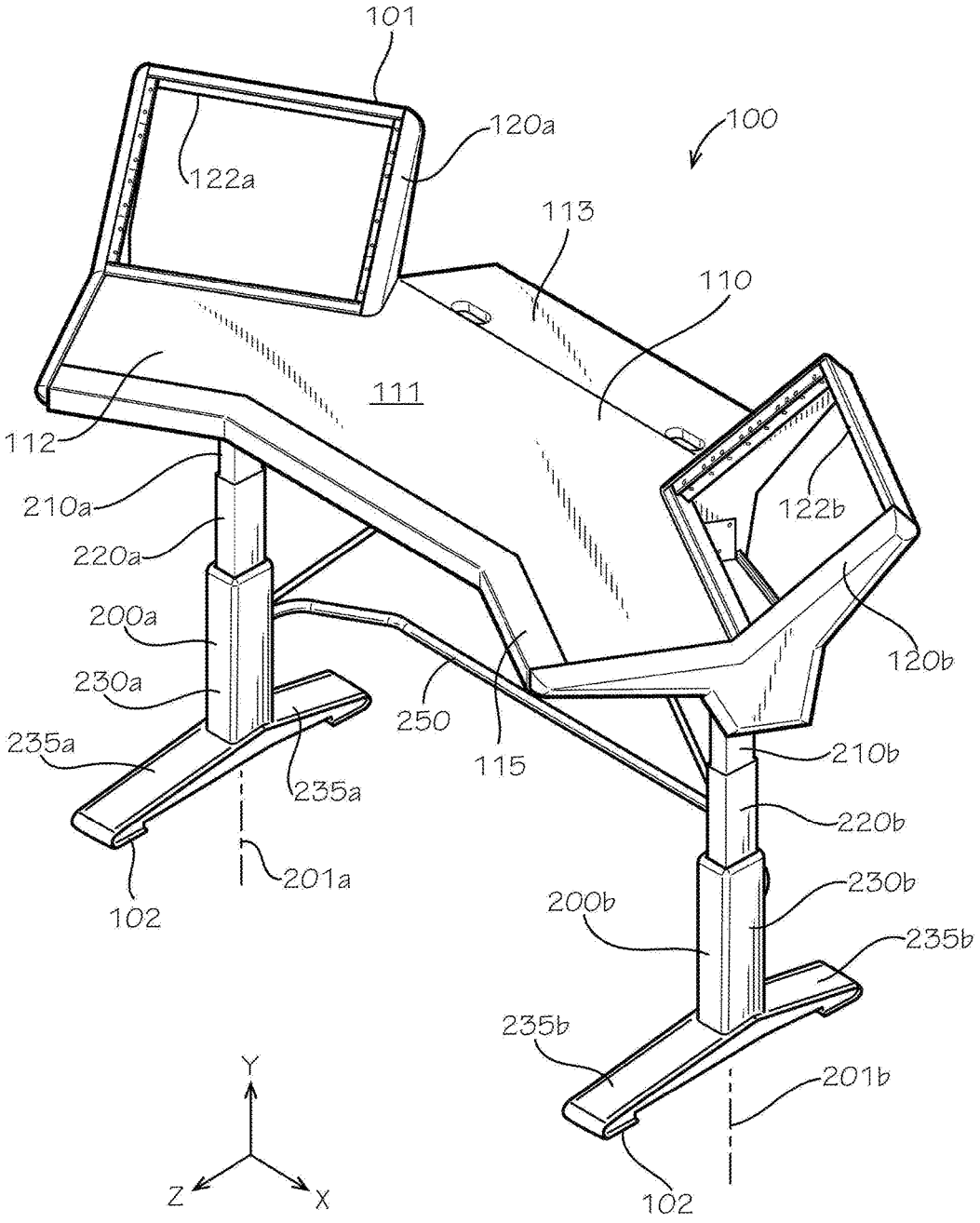
FIG. 1 is a front top perspective view of an adjustable sit-stand desk in accordance with one aspect of the current disclosure.

The present disclosure can be understood more readily by reference to the following detailed description, examples, drawings, and claims, and their previous and following description. However, before the present devices, systems, and/or methods are disclosed and described, it is to be understood that this disclosure is not limited to the specific devices, systems, and/or methods disclosed unless otherwise specified, as such can, of course, vary. It is also to be understood that the terminology used herein is for the purpose of describing particular aspects only and is not intended to be limiting.

The following description is provided as an enabling teaching of the present devices, systems, and/or methods in their best, currently known aspect. To this end, those skilled in the relevant art will recognize and appreciate that many changes can be made to the various aspects described herein, while still obtaining the beneficial results of the present disclosure. It will also be apparent that some of the desired benefits of the present disclosure can be obtained by selecting some of the features of the present disclosure without utilizing other features. Accordingly, those who work in the art will recognize that many modifications and adaptations to the present disclosure are possible and can even be desirable in certain circumstances and are a part of the present disclosure. Thus, the following description is provided as illustrative of the principles of the present disclosure and not in limitation thereof.

As used throughout, the singular forms "a," "an" and "the" include plural referents unless the context clearly dictates otherwise. Thus, for example, reference to a quantity of one of a particular element can comprise two or more such elements unless the context indicates otherwise.

Ranges can be expressed herein as from "about" one particular value, and/or to "about" another particular value. When such a range is expressed, another aspect comprises from the one particular value and/or to the other particular value. Similarly, when values are expressed as approximations, by use of the antecedent "about" or "substantially," it will be understood that the particular value forms another aspect. It will be further understood that the endpoints of each of the ranges are significant both in relation to the other endpoint, and independently of the other endpoint.

For purposes of the current disclosure, a material property or dimension measuring about X or substantially X on a particular measurement scale measures within a range between X plus an industry-standard upper tolerance for the specified measurement and X minus an industry-standard lower tolerance for the specified measurement. Because tolerances can vary between different materials, processes and between different models, the tolerance for a particular measurement of a particular component can fall within a range of tolerances.

As used herein, the terms "optional" or "optionally" mean that the subsequently described event or circumstance may or may not occur, and that the description comprises instances where said event or circumstance occurs and instances where it does not.

The word "or" as used herein means any one member of a particular list and also comprises any combination of members of that list.

To simplify the description of various elements disclosed herein, the conventions of "left," "right," "front," "rear," "top," "bottom," "upper," "lower," "inside," "outside," "inboard," "outboard," "horizontal," and/or "vertical" may be referenced. Unless stated otherwise, "front" describes that end of the desk nearest to and occupied by a user of the desk or facing in a positive Z-direction shown; "rear" is that end of the side that is opposite to or distal from the front or facing in a negative Z-direction; "left" is that which is to the left of or facing left from a person directly facing towards the front of the desk or facing in a negative X-direction; and "right" is that which is to the right of or facing right from that same person or facing in a positive X-direction. "Horizontal" or "horizontal orientation" describes that which is in a plane extending from left to right and aligned with the horizon. "Vertical" or "vertical orientation" describes that which is in a plane that is angled at 90 degrees to the horizontal or facing in a positive Y-direction shown.

In one aspect, a desk and associated methods, systems, devices, and various apparatuses are disclosed herein. In one aspect, the desk can comprise a desktop, legs, and a gas spring.

FIG. 1 shows a desk 100, which can be an adjustable sit-stand desk. The desk 100 can comprise a desktop 110 proximate to a top end 101. The desk 100 can also comprise a first leg 200*a*, a second leg 200*b*, and a leg stabilizer 250. The desktop 110 can define a desktop surface 111. The first leg 200*a* and the second leg 200*b* can define a bottom end 102 of the desk 100. In one aspect, the desktop 110 can comprise a first accessory opening 122*a* in a first accessory frame 120*a* and a second accessory opening 122*b* in a second accessory frame 120*b*. In another aspect, the desktop 110 can comprise one or no accessory openings. In yet another aspect, the desktop 110 can comprise more than two accessory openings. The accessory openings 122*a,b*, each of which can be a "rack bay" in a pro audio setting (typically 19 inches or approximately 483 mm high and having a rack unit or "RU" height measuring in increments of 1.75 inches), can be sized and configured to receive equipment such as, for example and without limitation, rack shelves, audio mixing hardware, computer storage devices, and audio and/or video recording and/or playback devices. In another aspect, the desktop 110 and the desk 100 generally can be used with or without any particular kind of equipment of can be used for any one of a variety of purposes and is not limited to use with audio and/or video equipment. The desktop 110 can optionally comprise a padded armrest 115, which can extend vertically, horizontally, or both vertically and horizontally from a surface of the desk 100 such as the desktop surface 111. In some aspects, the desktop 110 can itself be oriented in a horizontal or X-direction as shown. In other aspects, the desktop can be oriented in another direction.

Figure 24:
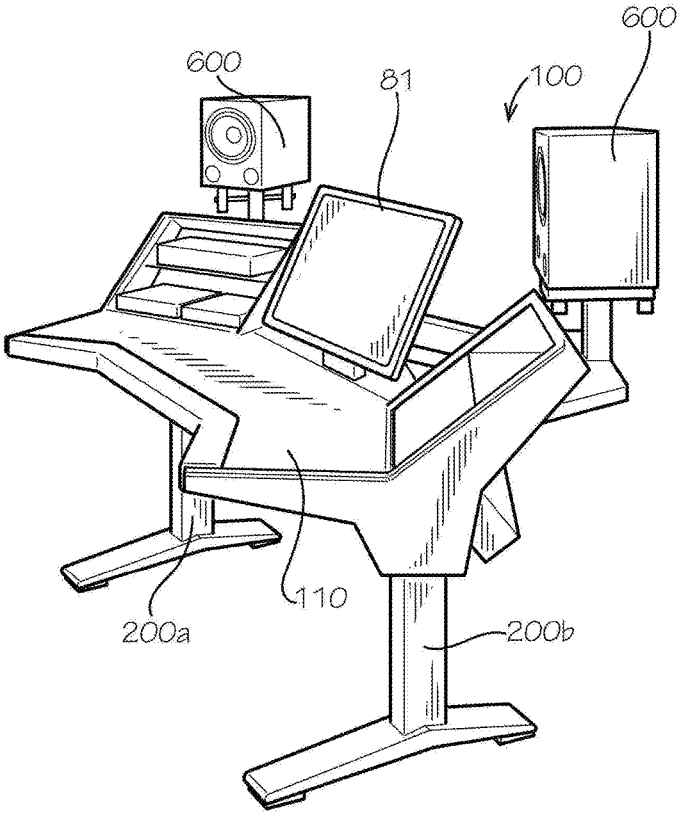
FIG. 24 is a side perspective view of the desk of FIG. 1 comprising a pair of speakers and a display monitor in accordance with another aspect of the current disclosure.

The desktop surface 111 of the desktop 110 can be stepped such that a secondary portion 113 is positioned above or below the desktop surface 111 or such that the accessory frames 120*a,b* extend above or below a main portion 112 as shown. In one aspect, the desktop surface 111 can be configured to receive a monitor 81 (shown in FIG. 24), a musical instrument such as an electronic keyboard 82 (shown in FIG. 25), a mixing board (not shown), or any other equipment as desired by the user. The desktop surface can define cable grommets and can comprise a surface texture and material suited for writing, cleaning, and general durability.

Figure 2:
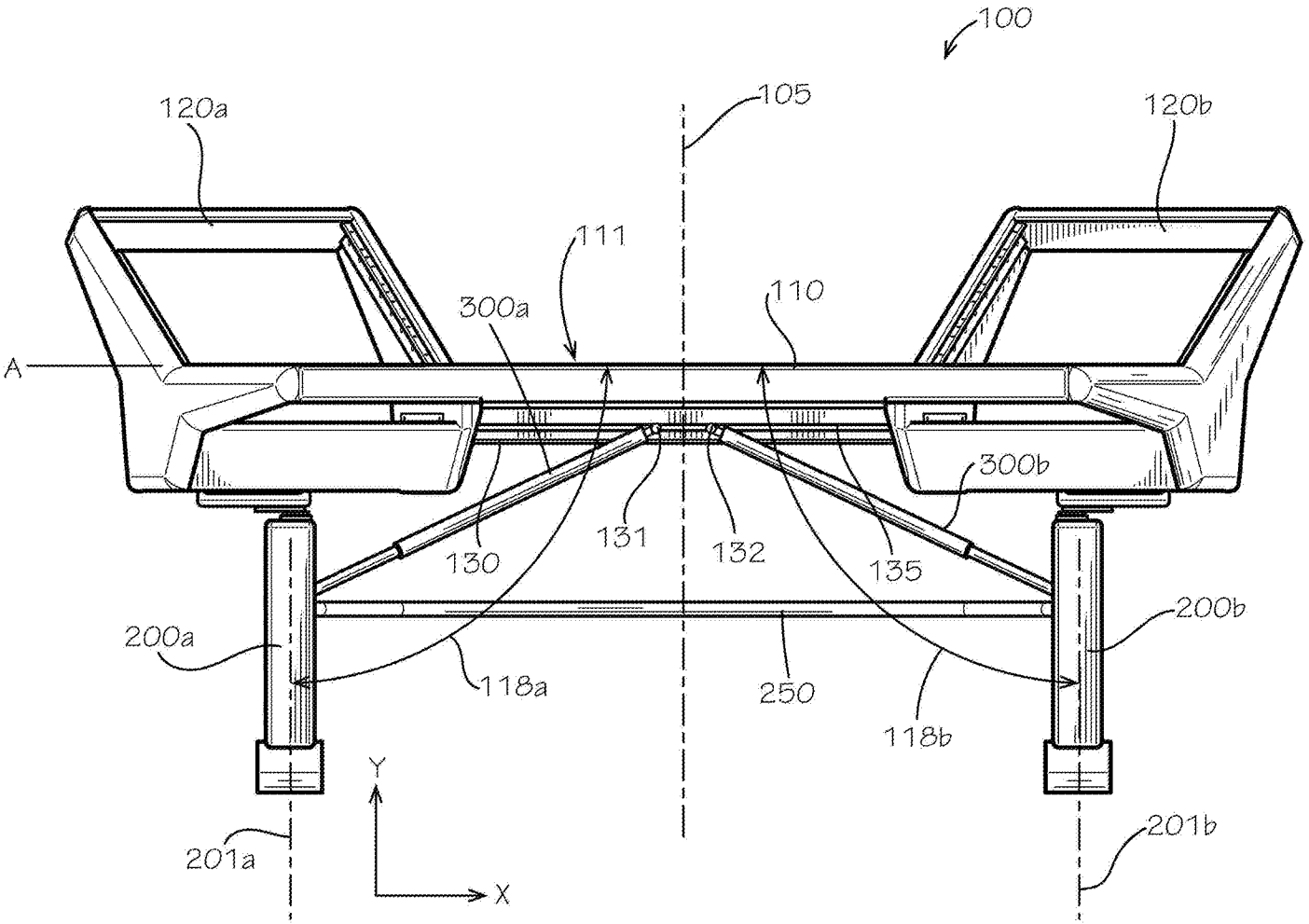
FIG. 2 is a front view of the desk of FIG. 1 in a lower position.

Each leg 200*a,b* can comprise an attachment portion 210*a,b*, respectively, which can be secured to the desktop 110 and can extend away from the desktop 110 in a direction angled with respect to the desktop 110—and specifically the desktop surface 111—at an angle 118*a,b*, respectively (shown in FIG. 2). Each leg 200*a,b* can further comprise a foot portion 230*a,b*, respectively, which can each comprise a foot 235*a,b*, respectively, together defining the bottom end 102 of the desk 100 and each foot 235*a,b* extending from an axis 201*a,b*, respectively, of the leg 200*a,b* in a substantially horizontal direction towards a front and a rear of the desk 100. Each leg 200*a,b* can further comprise an intermediate portion 220*a,b*, respectively, which can connect the attachment portion 210*a,b* to the foot portion 230*a,b* as shown. The legs 200*a,b* and other components of the desk 100 can be formed from a material such as, for example and without limitation, steel or aluminum and can be finished with paint, powdercoating, anodizing, or any other finish as desired.

The attachment portion 210*a,b* of each leg 200*a,b* can be configured to move with respect to the foot portion 230*a,b* of the respective leg 200*a,b* along the respective axis 201*a,b* of the legs 200*a,b*. Likewise, the intermediate portion 220*a,b* of each leg 200*a,b* can also be configured to move with respect to the foot portion 230*a,b* of the respective leg 200*a,b* along the respective axis 201*a,b*. In one aspect, the movement and structure of each leg 200*a,b* can be telescopic. As shown, the attachment portion 210*a,b* can nest and move within the intermediate portion 220*a,b*, which can nest and move within the foot portion 230*a,b*. In another aspect, the movement of each leg 200*a,b* can be substantially along the respective axis 201*a,b*. The movement of each leg 200*a,b* can be substantially linear along the respective axis 201*a,b*. In one aspect, as shown, the movement of the legs 200*a,b* and the axes 201*a,b* can be in a substantially vertical orientation. In another aspect, the movement of the legs 200*a,b* and the axes 201*a,b* can be angled with respect to a substantially vertical orientation.

Figure 3:
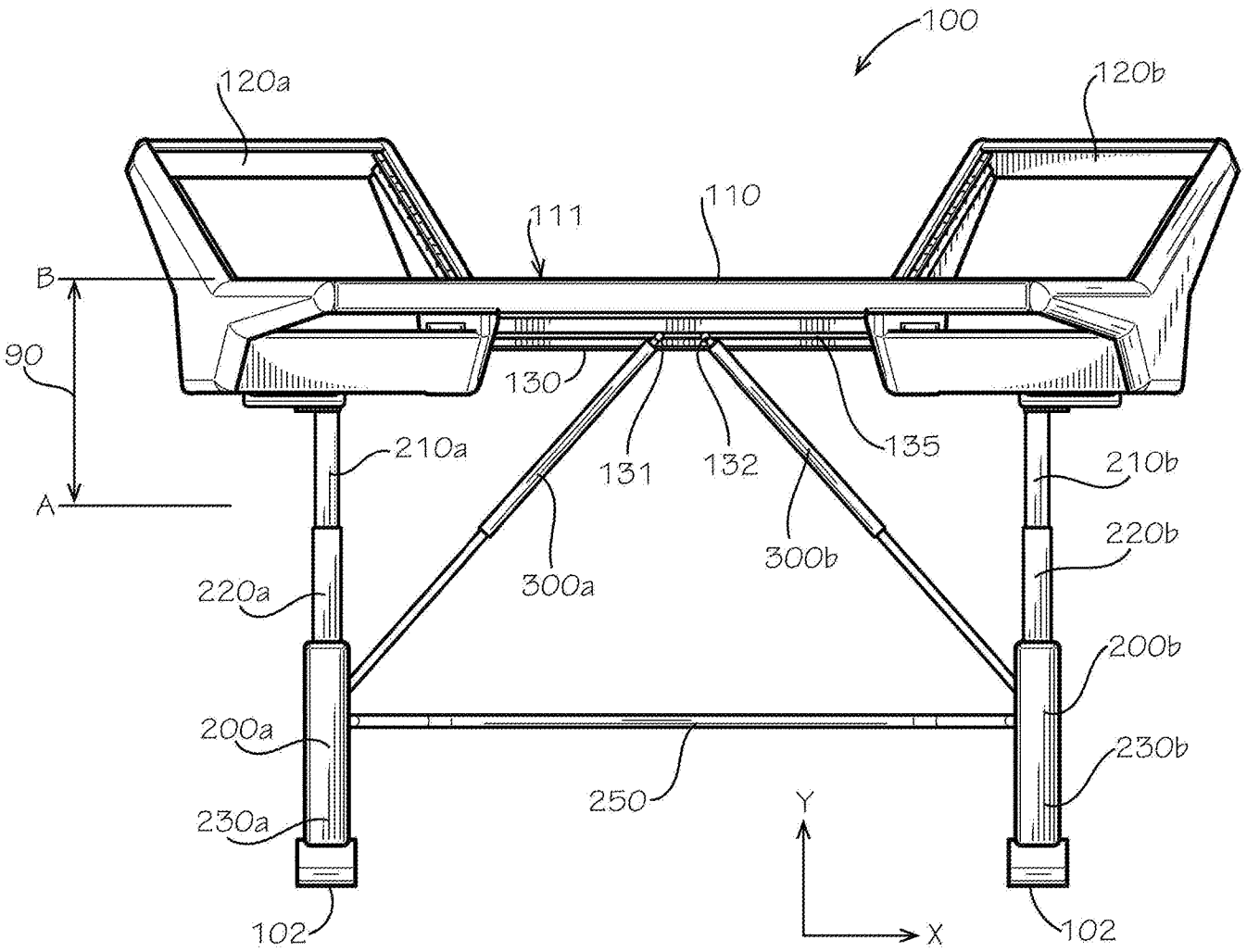
FIG. 3 is a front view of the desk of FIG. 1 in an upper position.

As shown in FIGS. 2 and 3, aspects of which will be discussed in further detail below, the height of the desktop surface 111 of the desk 100 can be adjustable between a lower position A (shown in FIG. 2) and an upper position B (shown in FIG. 3) and anywhere in between the lower position A and the upper position B, which together can define an adjustment distance 90 measured from the lower position A to the upper position B. In some aspects, the lower position A can be set at a height H of 27 inches from a floor surface 500 (shown in FIGS. 5 and 6). In other aspects, the lower position A can be set at a height H of 24 inches from a floor surface 500. In other aspects, the lower position A can be set at any one of a range of ergonomic positions at which a user of the desk 100 is in a sitting position. In some aspects, the upper position B can be set at a height H of 42 inches from the floor. In other aspects, the upper position B can be set at a height H of 48 inches from the floor. In other aspects, the upper position B can be set at any one of a range of ergonomic positions at which a user of the desk 100 is in a standing position. Due to the flexibility of being able to sit or stand while using the desk 100, the desk 100 can be considered a "sit-stand" desk (and can also be described with the other names previously mentioned).

In one aspect, also as shown in FIGS. 2 and 3, the desk 100 can further comprise a pair of gas springs 300*a,b* connecting at least one of the pair of legs 200*a,b* to the desktop 110. In another aspect, only a single gas spring 300 or more than two gas springs 300 can be assembled to the desk 100. The gas springs 300*a,b* can be configured to both resist movement of the desk when jarred and also quickly dampen and stop any movement that does occur, even when the desktop 110 is loaded such that as much as 100 pounds or more in addition to the weight of the desktop 110 itself is supported by the desk 100. The gas springs 300*a,b* can be secured to a cross rail 130 extending below the desktop surface 111 of the desktop 110 at attachment points 131 and 132, respectively, which can be positioned proximate to and equidistant about a centerline 105 of the desk 100. The cross rail 130 can be, for example and without limitation, an extruded aluminum frame sized to extend the entire length of the desk 100 or, as shown, can be sized to extend only from the accessory frame 120*a* to the accessory frame 120*b*.

The attachment points 131, 132 can be permanent or fixed or can be adjustable along a range of discrete or infinitely variable positions inside, for example and without limitation, a groove 135 defined in the cross rail 130. In one aspect, as shown, the attachment points 131, 132 can be positioned on a front side of the cross rail 130. In another aspect, the attachment points 131, 132 can be positioned on a rear side of the cross rail 130.

Figure 4:
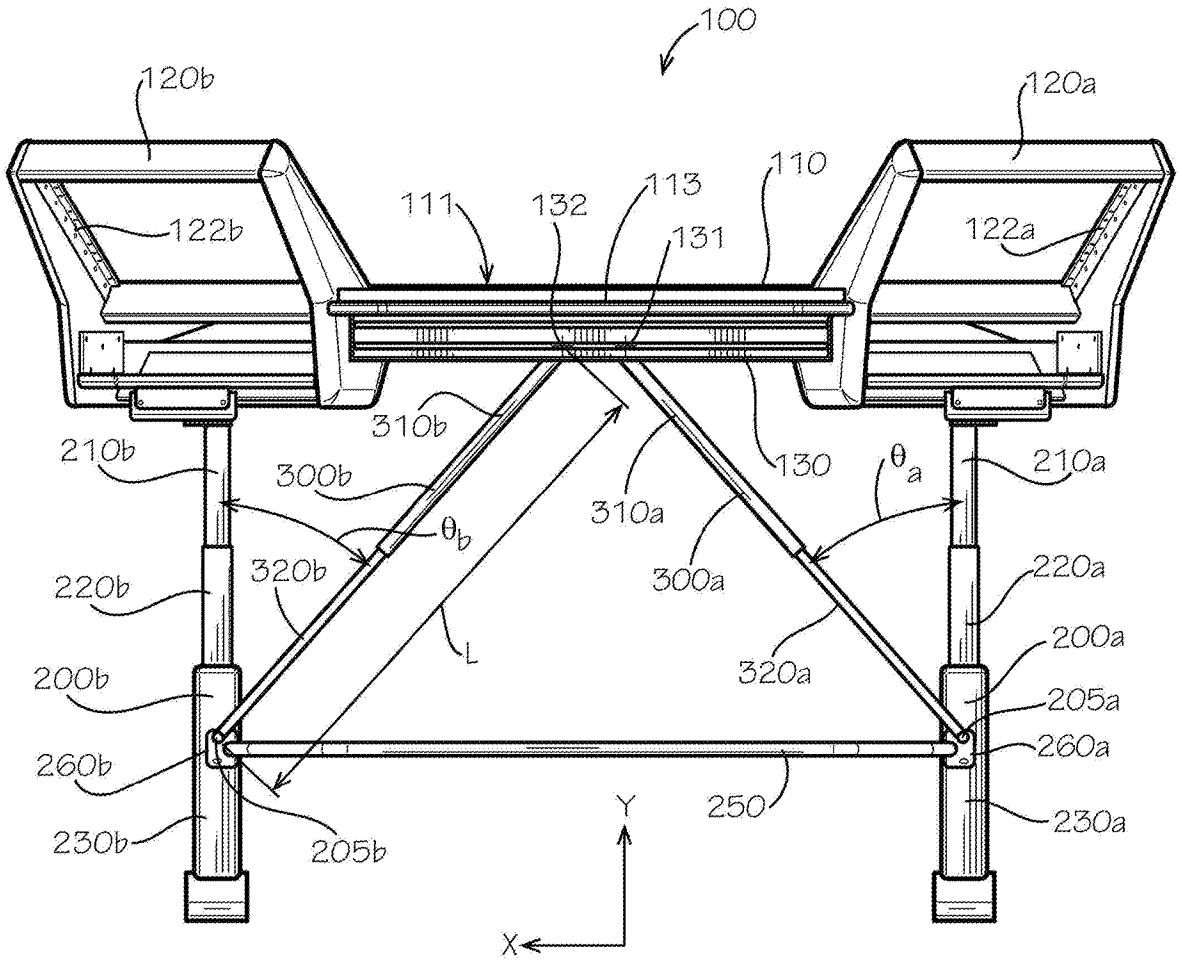
FIG. 4 is a rear view of the desk of FIG. 3.

As shown in FIG. 4, the leg stabilizer 250 can be secured to and can extend from the first leg 200*a* to the second leg 200*b* to, for example and without limitation, resist horizontal movement of one leg 200*a,b* with respect to the other leg 200*a,b*, including when the gas springs 300*a,b* exert outward forces on the legs 200*a,b*. In one aspect, as shown, a first end 260*a* of the leg stabilizer 250 is secured to the foot portion 230*a* of the first leg 200*a*, and a second end 260*b* of the leg stabilizer 250 is secured to the foot portion 230*b* of the second leg 200*b*. The gas springs 300*a,b* can be attached to attachment points 205*a,b* on the respective legs 200*a,b*. In one aspect, the attachment points 205*a,b* can be part of the respective foot portion 230*a,b* of each leg 200*a,b*. In another aspect, the attachment points 205*a,b* can be incorporated into another portion of the leg 200*a,b*.

The attachment points 205*a,b* can be permanent or fixed or can be adjustable along a range of discrete or infinitely variable positions on the leg 200*a,b*. In one aspect, as shown, each of the attachment points 205*a,b* can be positioned on a rear side of each of the respective legs 200*a,b*. In another aspect, each of the attachment points 205*a,b* can be positioned on a front side of each of the legs 200*a,b*.

In one aspect, each of the gas springs 300*a,b* can be a gas-filled spring, a gas strut, a gas cylinder, or a shock absorber, any of which can define one or more inner chambers filled and sealed with a compressed gas that allows—with resistance—extension and contraction of a shaft 320*a,b* of the gas spring 300*a,b* with respect to a body 310*a,b* of the gas spring 300*a,b*. Thus a length L of the gas springs 300*a,b* can automatically lengthen during raising of the desktop 110 and shorten during lowering of the desktop 110. As will be described further below, each of the gas springs 300*a,b* can be configured to snap onto the desk 100 without tools using simple mechanical connections. The shaft 320*a,b* can also be a rod, and the body 310*a,b* can also be a tube.

The placement and symmetry of the gas springs 300*a,b* can be beneficial to the performance of the desk 100. For example, symmetry of the attachment points 131, 132 and the attachment points 205*a,b* about the centerline 105, and symmetric orientation of the gas springs 300*a,b* about the centerline 105, for example as shown by angles $\Theta$ and $\phi$ (more specifically, angles $\Theta_a$ and $\Theta_b$ and angles $\phi_a$ and $\phi_b$), can result in improved operation of the gas springs 300*a,b*. In addition, the lifting actuators (not shown due to their being located inside the legs 200*a,b*) can comprise a motor-driven screw-style actuator and are generally designed to push loads, not pull loads. Thus correct matching of the gas spring 300*a,b* to the desk 100 can also be beneficial. For example, sufficiently strong gas springs 300*a,b* can help offset the tare weight of the superstructure of the desk 100, which can enable the actuators inside the legs 200*a,b* to work more efficiently. Over-sizing the compression specification of the gas springs 300*a,b*, however, such that the resistance created inside the gas spring 300*a,b* is more than necessary to create the beneficial effects described herein, can cause the actuators inside the legs 200*a,b* to strain to lower the desk 100 from its standing height or from the upper position B.

With the desk 100 at its full height proximate to the upper position B and with the gas springs 300*a,b* fully extended, depending on the placement of the load, the first gas spring 300*a* can act as a rigid brace for the first leg 200*a* while the second gas spring 300*b* can act as a shock absorber for the other leg 200*b*, or vice versa. At all height settings or any height H (shown in FIGS. 5 and 6) of the desk 100, the gas springs 300*a,b* can act as shock absorbers to minimize sympathetic or harmonic movement from side to side. Also, where loads such as speakers 600*a,b* (shown in FIG. 20) are placed higher on the desk 100, the gas springs 300*a,b* can dampen the inertia created when the desk 100 is bumped. Even if the desk 100 does move, the desk 100 can quickly return to a neutral or equilibrium position instead of continuing to shake, bounce, or sway.

For the desk 100, in various aspects, gas springs 300*a,b* substantially matching the specifications of, for example and without limitation, a LIFT-O-MAT® gas spring from STABILUS Inc. of Gastonia, N.C., USA, or from STABILUS GmbH of Koblenz, Germany, can be used successfully (for example and without limitation, a gas spring with the designation "1141EA 0250N 178/16 A R" and having a compression load setting of approximately 250 N or 50 pounds and an uncompressed length L of approximately 900 mm or 35.5 inches can be used). In other aspects, including aspects involving other desks 100 of different sizes or weights or qualities, gas springs with larger or smaller compression load settings or shorter or longer uncompressed lengths can be used.

Either of the gas springs 300*a,b* can be angled with respect to the respective leg 200*a,b* by a non-90-degree angle and with respect to the desktop 110 by a non-90-degree angle. The angles $\Theta_a$ and $\Theta_b$ can describe an angular position of each of the gas springs 300*a,b* with respect to the respective leg 200*a,b* in the X-Y plane shown in FIG. 4. More specifically, the angle $\Theta_a$ and $\Theta_b$ can describe an angular position of the respective gas springs 300*a,b* with respect to a vertical orientation or the Y-direction (shown in FIG. 1) defining, for example and without limitation, the axes 201*a,b* (shown in FIG. 2).

Figure 6:
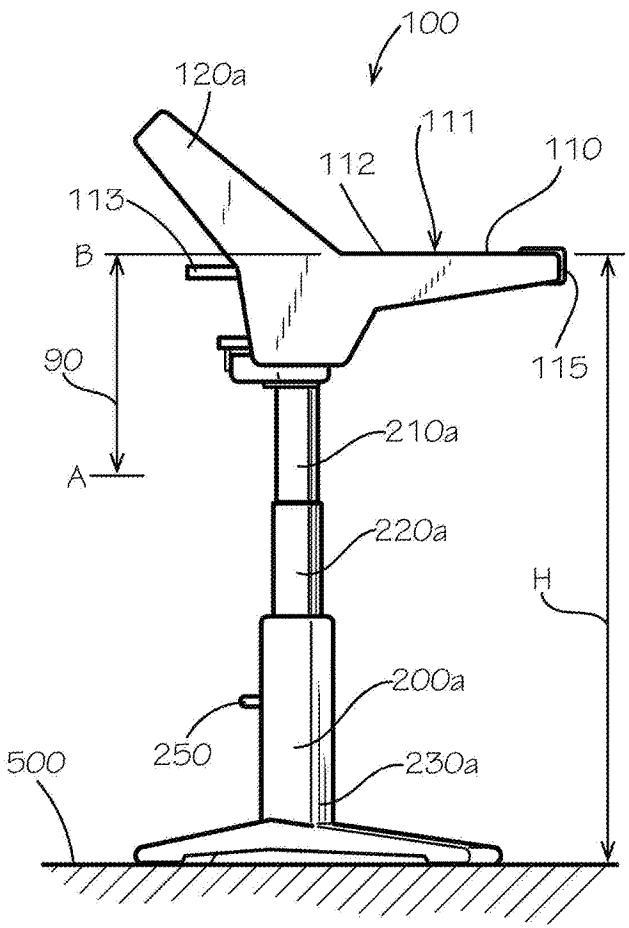
FIG. 6 is a side perspective view of the desk of FIG. 3 taken along line 5-5 of FIG. 7 with the desktop positioned at the upper position shown in FIG. 3.
Figure 5:
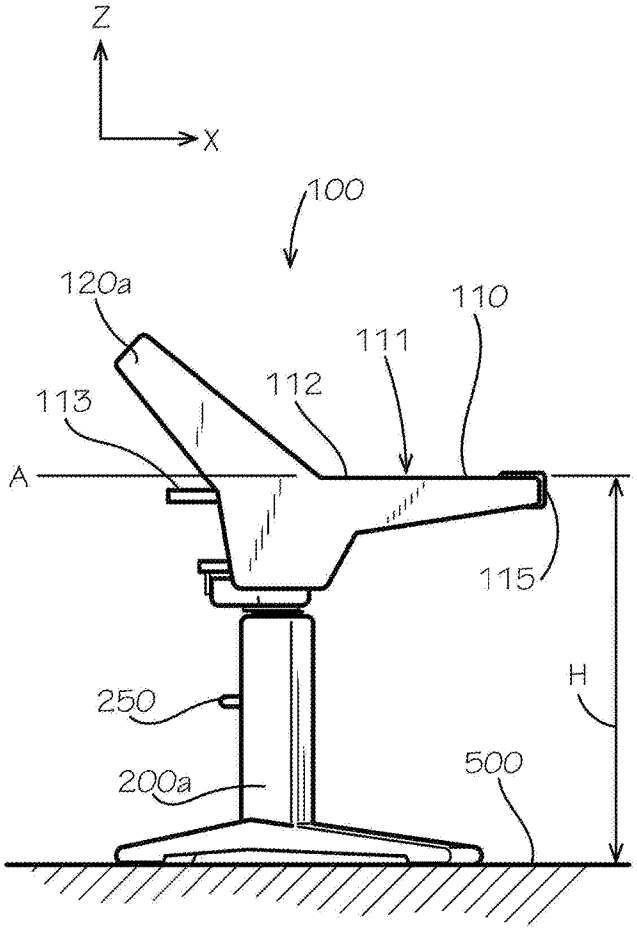
FIG. 5 is a side perspective view of the desk of FIG. 2 taken along line 5-5 of FIG. 7 with the desktop positioned at the lower position shown in FIG. 2.

As shown in FIGS. 5 and 6, as described above, the desk 100 can be configured to adjust the desktop surface 111 of the desktop 110 from the lower position A to the upper position B. Such adjustment can effectively adjust in the Y-direction (shown in FIG. 1) the height H between a floor surface 500 and the desktop surface 111.

Figure 7:
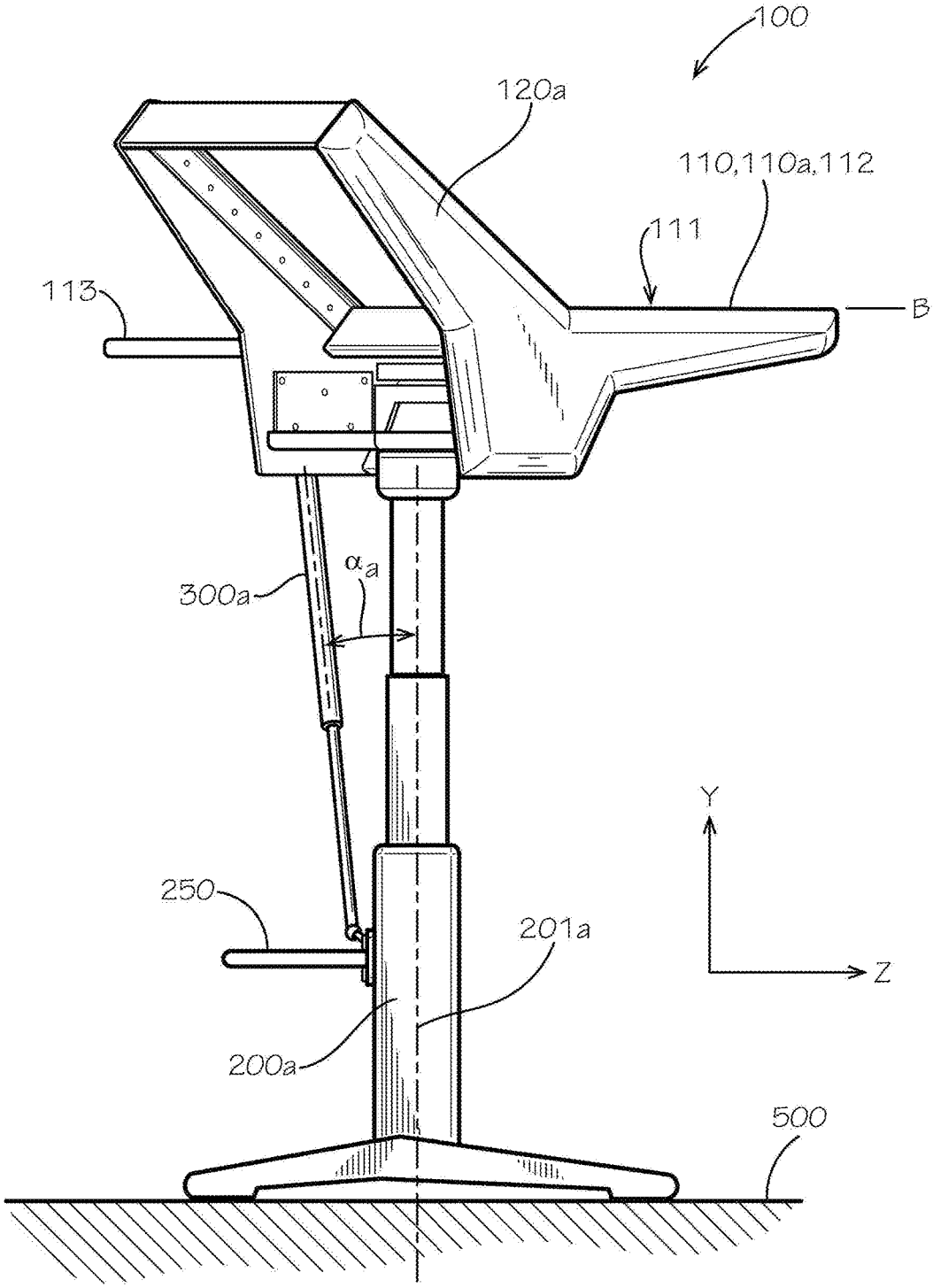
FIG. 7 is a side view of the desk of FIG. 3 with the desktop positioned at the upper position shown in FIG. 3.

As shown in FIG. 7, the angles $\alpha_a$ and $\alpha_b$ ($\alpha_b$ not shown) can describe an angular position of each of the gas springs 300*a,b* with respect to a transverse direction of the desk 100 such as defined by, for example and without limitation, the X-Y plane shown in FIG. 2. The gas springs 300*a,b* thus need not be aligned with the transverse direction of the desk (i.e., the X-direction) and can thus extend at least partially in the Z-direction as shown. As shown, the gas springs 300*a,b* can be angled towards a rear of the desk 100 (or in a negative Z-direction).

Figure 8:
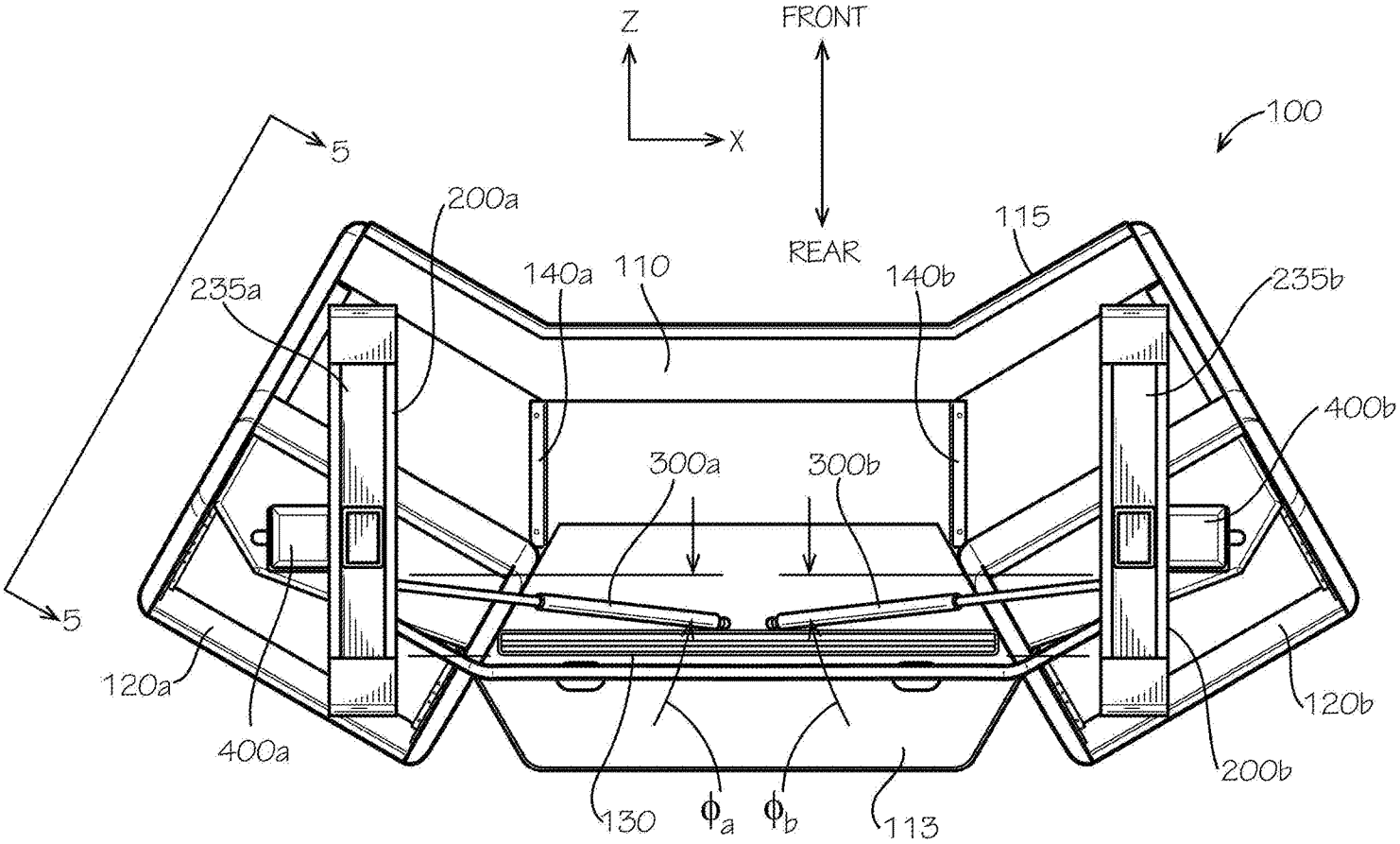
FIG. 8 is a bottom plan view of the desk of FIG. 3.

As shown in FIG. 8, the desk 100 can comprise a drive unit 400*a,b* proximate to each leg 200*a,b* and configured to drive the lengthening or shortening of the legs 200*a,b* via the aforementioned actuators. Each of the drive units 400*a,b* can be secured to a bottom side or underside of the desktop 110. In one aspect, each of the drive units 400*a,b* can be positioned between the desktop 110 and the attachment portion 210*a,b* of the leg 200*a,b*. In another aspect, both the drive units 400*a,b* and the attachments portions 210*a,b* of the legs 200*a,b* can be secured directly to the desktop 110. Also shown is the orientation of the previously defined front and rear directions of the desk 100. The angles $\phi a$ and $\phi b$ can describe an angular position of the respective gas springs 300*a,b* with respect to a transverse direction of the desk 100 such as defined by, for example and without limitation, the cross rail 130 or in the X-Z plane shown in FIG. 8. The gas springs 300*a,b* thus need not be aligned with the transverse direction of the desk (i.e., the X-direction) and can thus extend at least partially in the Z-direction as shown.

FIGS. 9-13 show additional views of the bottom side of the desk 100*a* including each of the desktop 110, the legs 200*a,b*, and the drive units 400*a,b*. As shown, the leg stabilizer 250 can be connected to each of the legs 200*a,b* with a bracket 270*a,b*.

Figure 11:
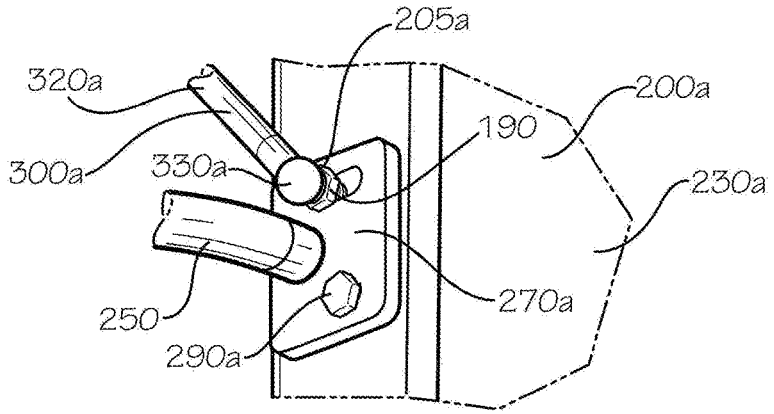
FIG. 11 is a detail view of a connection between a gas spring and a leg of the desk of FIG. 3 taken from detail 11 of FIG. 9.

As shown in FIG. 11, each of the gas springs 300*a,b* can comprise a joint 330*a,b* (330*b* not shown), which can comprise a socket joint defining a spherically shaped inside cavity, at the end of the shaft 320*a,b*. The joint 330*a,b* can then be secured to a connecting fastener 190, which can be assembled to the leg 200*a* through the bracket 270*a* through any desired connection such as, for example and without limitation, a threaded connection. As shown, the bracket 270*a* can be secured to the leg 200*a* (and similarly the bracket 270*b* to the leg 200*b*) with a fastener 290*a*.

Figure 12:
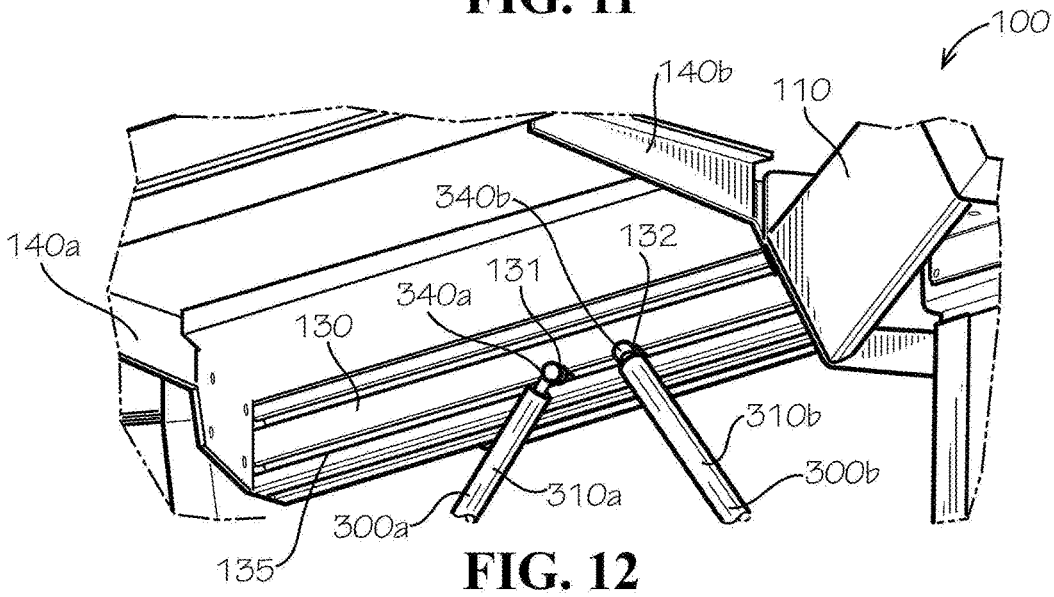
FIG. 12 is a detail view of a connection between the gas spring and the leg of the desk of FIG. 3 taken from detail 12 of FIG. 10.
Figure 13:
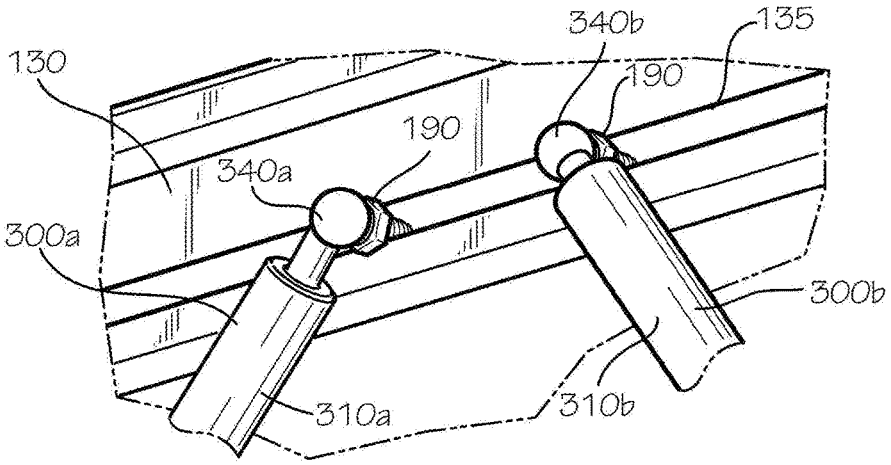
FIG. 13 is a detail view of a connection between the gas spring and the leg of the desk of FIG. 3 taken from detail 13 of FIG. 10.

As shown in FIGS. 12 and 13, each of the gas springs 300*a,b* can comprise a joint 340*a,b*, respectively, which can be a socket joint, at the end of the shaft 320*a*. Each joint 330*a* can then be secured to the connecting fastener 190, which can be assembled to the cross rail 130. Optionally, a nut (not shown) riding inside the groove 135 of the cross rail 130 can be used to secure the connecting fastener 190 to the cross rail 130, including when, for example and without limitation, the groove 135 defines an internal channel in which the nut can be received that can prevent rotation of the nut and also a channel for the connecting fastener 190 that will not allow axial movement of the nut out of the groove 135 (i.e., it is sized to retain the nut).

Figure 14:
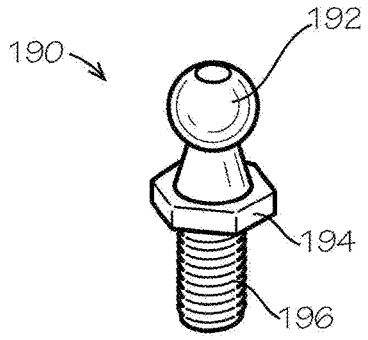
FIG. 14 is a connecting fastener of the desk of FIG. 1.

FIG. 14 shows the connecting fastener 190, which can be a ball stud comprising a ball portion 192 defining at least in part a spherical shape, a hex portion 194 to facilitate installation and tightening of the connecting fastener 190, and a threaded portion 196.

Figure 15:
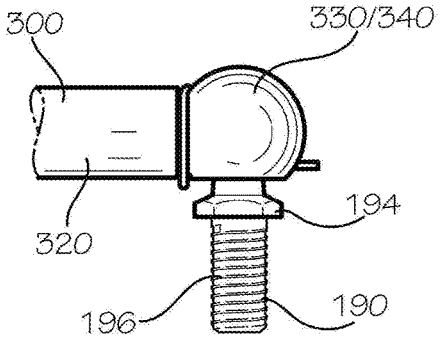
FIG. 15 is the gas spring of FIG. 11 secured to the connecting fastener of FIG. 14.

FIG. 15 shows the connecting fastener 190 received within the joint 330 or the joint 340 of the gas spring 300.

Figure 16:
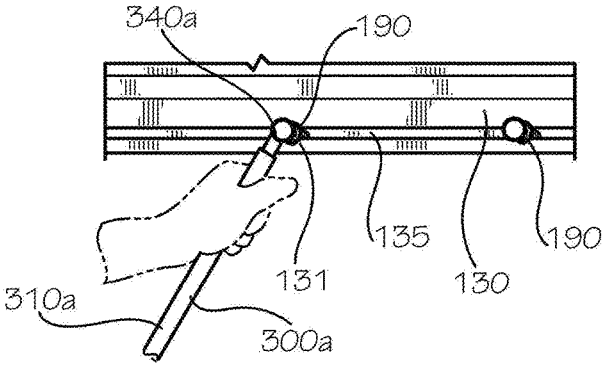
FIG. 16 is a perspective view of a first gas spring being connected to a first connecting fastener of the desktop of the desk of FIG. 1.
Figure 17:
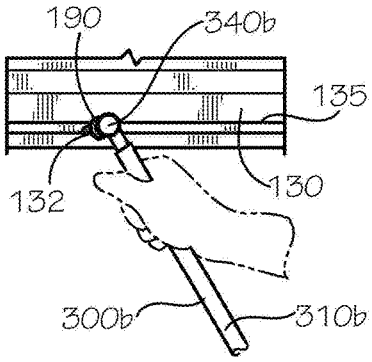
FIG. 17 is a perspective view of a second gas spring being connected to a second connecting fastener of the desktop of the desk of FIG. 1.
Figure 18:
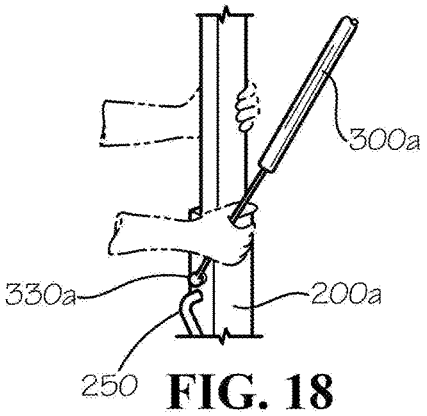
FIG. 18 is a perspective view of the first gas spring of FIG. 16 being connected to a connecting fastener of a first leg of a pair of legs of the desk of FIG. 1.
Figure 19:
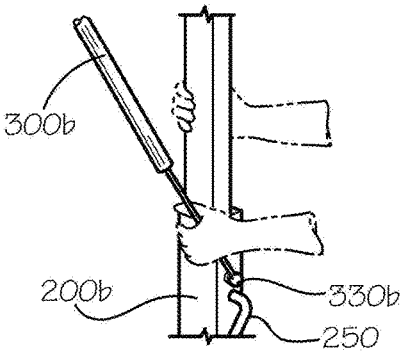
FIG. 19 is a perspective view of the second gas spring of FIG. 17 being connected to a connecting fastener of a second leg of a pair of legs of the desk of FIG. 1.

FIGS. 16-19 show a method of assembling the desk 100 comprising securing the gas springs 300*a,b* between the desktop 110 and the legs 200*a,b* of the desk 100. More specifically, FIG. 16 shows a user attaching the joint 340*a* of the gas spring 300*a* to the connecting fastener 190 positioned at the attachment point 131 by simply pressing or snapping the joint 340*a* onto the connecting fastener 190. Likewise, FIG. 17 shows a user attaching the joint 340*b* of the gas spring 300*b* to the connecting fastener 190 positioned at the attachment point 132 by simply pressing or snapping the joint 340*b* onto the connecting fastener 190. FIG. 18 shows a user attaching the joint 330*a* of the gas spring 300*a* to the connecting fastener 190 positioned at the attachment point 205*a* by simply pressing or snapping the joint 330*a* onto the connecting fastener 190. Likewise, FIG. 19 shows a user attaching the joint 330*b* of the gas spring 300*b* to the connecting fastener 190 positioned at the attachment point 205*b* by simply pressing or snapping the joint 330*b* onto the connecting fastener 190. As shown, the connections between each of the gas springs 300*a,b* and the desktop 110 or the legs 200*a,b* can be made secure and also serviceable without tools. After attaching the gas springs 300*a,b* to the desk 100, a method of using the desk 100 can comprise raising the desk from the lower position A to the upper position B. The method of using the desk 100 can further comprise lowering the desk from the upper position B to the lower position A.

Figure 20:
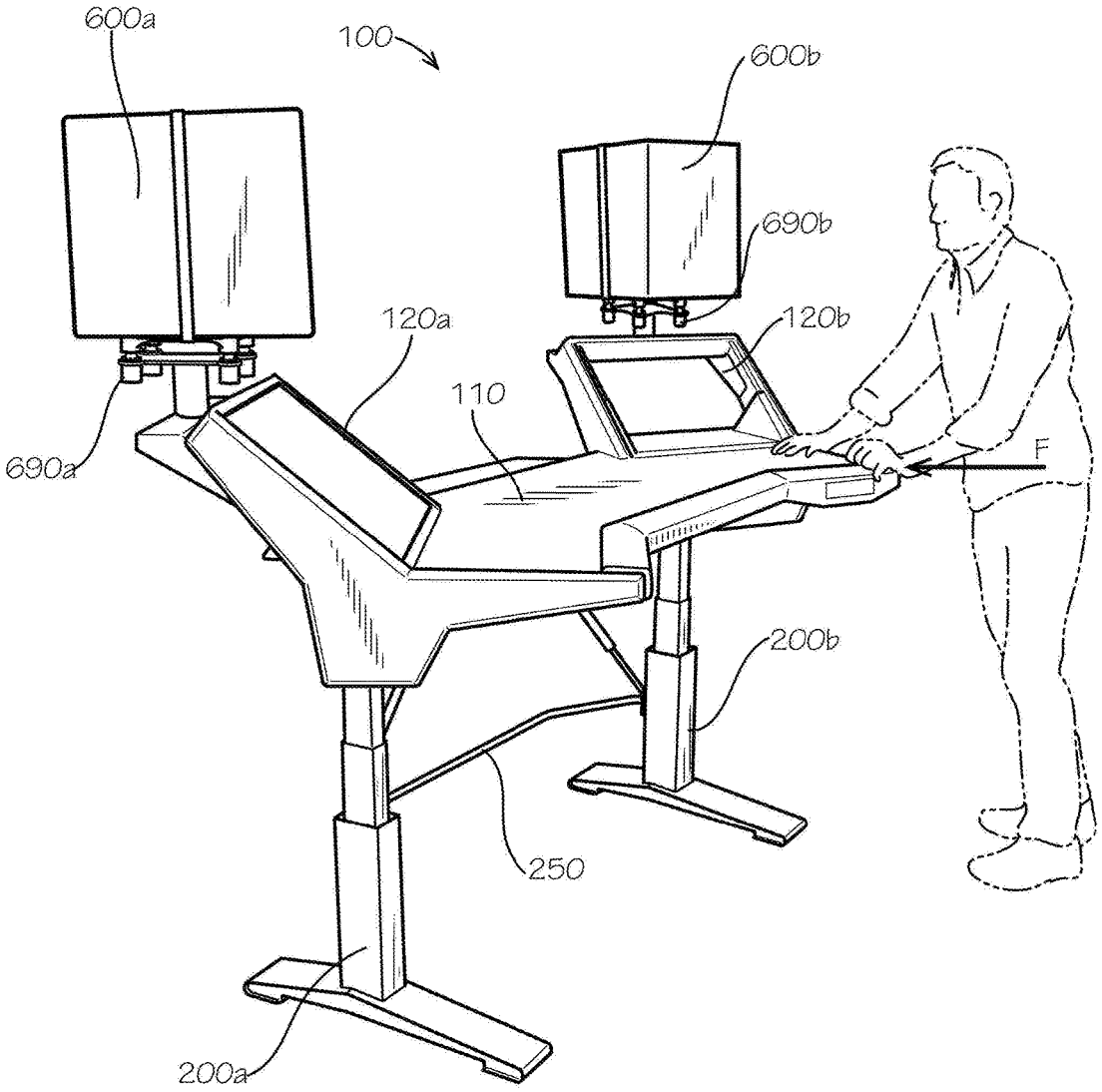
FIG. 20 is the desk of FIG. 1 with a pair of simulated speakers secured to the desktop in accordance with another aspect of the current disclosure, the desk shown being pushed with a horizontal force.
Figure 21:
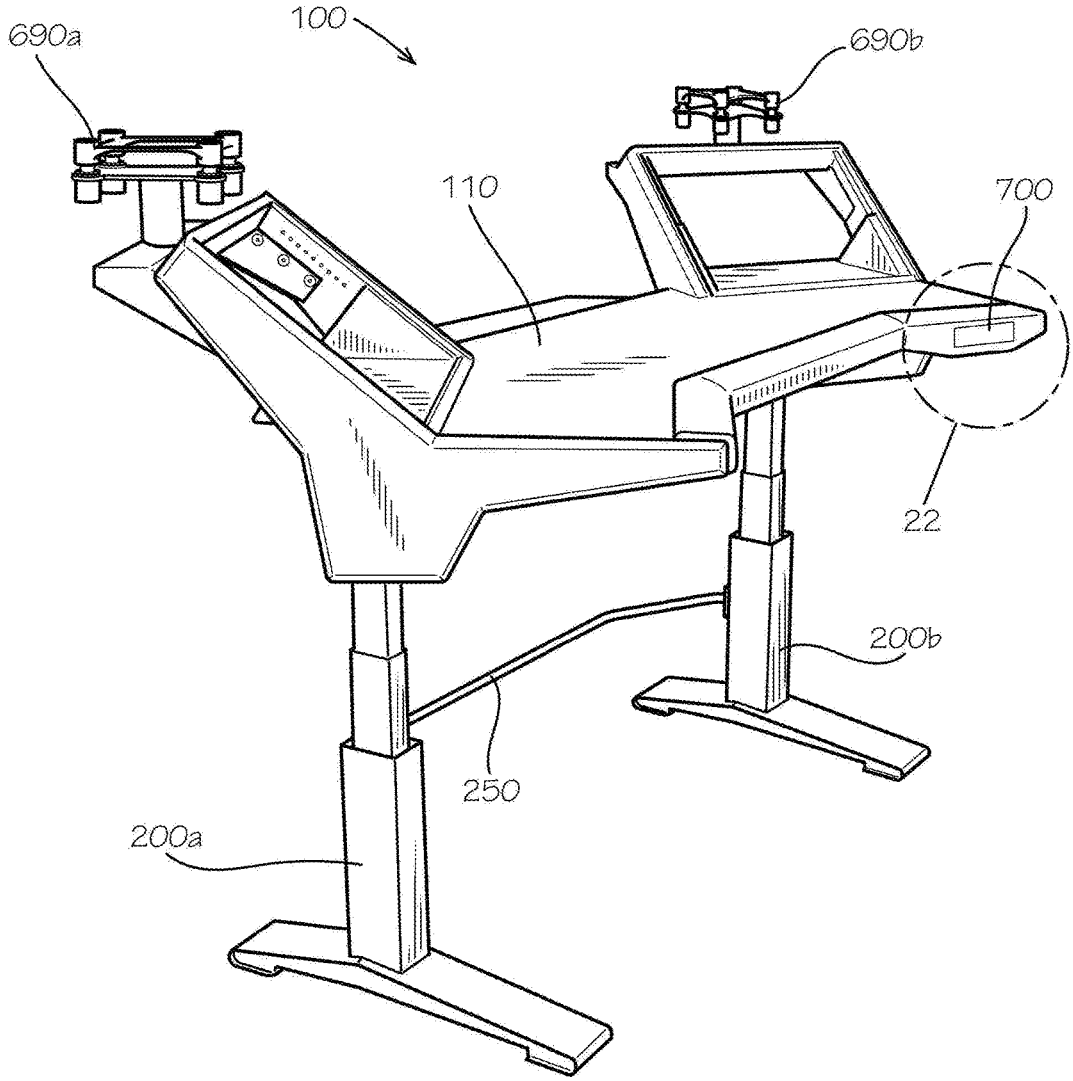
FIG. 21 is side perspective view of the desk of FIG. 19 with the simulated speakers and gas springs removed.

As shown in FIG. 20, the method of using the desk 100 can further comprise pushing the desk 100 in a substantially horizontal direction with a force such as a push force F shown that will tend to cause rocking, swaying, or vibration of the desk 100. As shown, for example and without limitation, the speakers 600*a,b*—represented in FIG. 20 by a box weighing as much as 50 pounds or more—can be attached to each of the accessory frames 120*a,b*. Even with a strong push, the presence of the gas springs 300*a,b* can cause the desk 100 and everything attached to it to resist movement and can dampen any movement that occurs. As shown in both FIGS. 20 and 21, the speakers 600*a,b* can be separated from the balance of the desk 100 by mounts 690*a,b*, which can be configured to isolate the vibration of the speakers and can be supported by speaker mount brackets (not shown). The mounts 690*a,b* can comprise, for example and without limitation, the IsoAcoustics® speaker platform available from IsoAcoustics Inc. of Markham, Ontario, Canada. FIG. 21 shows the desk 100 without the gas springs 300*a,b* installed.

Figure 22:
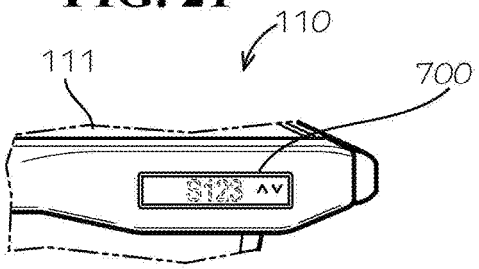
FIG. 22 is a detail view of a desk adjustment controller of the desk of FIG. 1 taken from detail 22 of FIG. 21.

As shown in FIGS. 21 and 22, the desk 100 can comprise a desk adjustment controller 700 comprising a user interface with input controls configured to adjust the extension or contraction of the legs 200*a,b* via control of the drive units 400*a,b*. Using the drive units 400*a,b*, various positions of the desktop surface 111 can be programmed and physically achieved.

Figure 23:
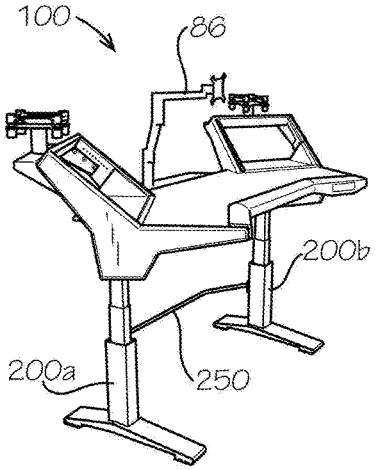
FIG. 23 is a side perspective view of the adjustable sit-stand desk of FIG. 1 comprising an accessory mounting bracket in accordance with another aspect of the current disclosure.
Figure 25:
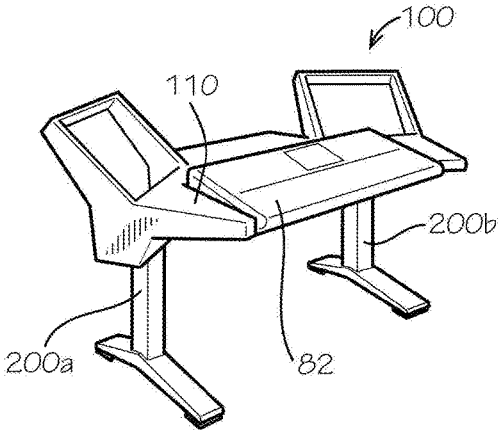
FIG. 25 is a left front top perspective view of a version of the desk of FIG. 1 comprising a keyboard on a keyboard shelf in accordance with another aspect of the current disclosure, the desk shown being not adjustable with respect to height.
Figure 26:
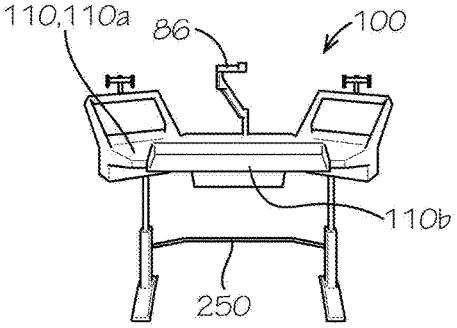
FIG. 26 is a front perspective view of the adjustable sit-stand desk of FIG. 25 with the keyboard of FIG. 25 removed in accordance with another aspect of the current disclosure.

FIGS. 23-26 show various configurations of the desk 100 with various equipment on the desktop 110. In one aspect, as shown in FIGS. 23 and 26, the gas springs 300*a,b* can be attached to an adjustable sit-stand desk such as the desk 100. In another aspect, the gas springs 300*a,b* can be attached to a stationary, non-adjustable desk that permanently maintains the desktop surface 111 at a single height. While the swaying of the desk 100 can be reduced by the substitution of rigid legs for telescoping legs, it is contemplated that benefits can be achieved on any desk 100 by the use of the gas springs as described herein and not only their use on adjustable desks. In another aspect, the gas springs 300*a,b* can be used on any flat desk and on legs, desktops, tabletops, or countertops of different shapes, sizes, and configurations—including a desk without a superstructure—to achieve similar benefits as described herein. In addition, in various aspects, other methods of attachment of the gas springs 300*a,b* to the desktop 110 or the legs 200 can be used. As shown in FIGS. 23 and 26, the desk 100 can comprise a bracket 86 configured to support additional structures such as, for example and without limitation, the monitor 81. As shown in FIG. 25, the desktop 110 of the desk 100 can support equipment such as the keyboard 82. More specifically, as shown in FIG. 26, a second portion 110*b* offset from a first portion 110*a* of the desktop 110 can function as a keyboard shelf for supporting the keyboard 82.

In some aspects, the disclosed gas springs 300*a,b* are not needed and are not used to adjust the height of the desktop 110 or otherwise move the components of the desk 100 with respect to each other and are used only for stability and to prevent such movement.

Figure 27:
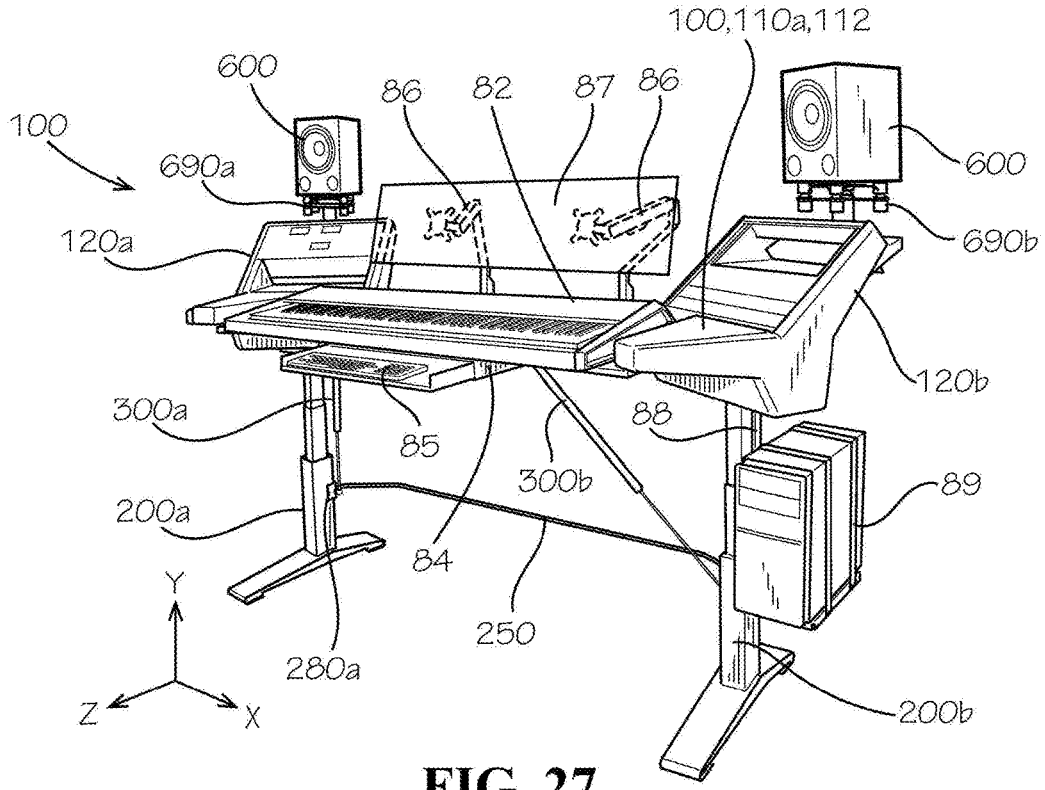
FIG. 27 is a right front top perspective view of the adjustable sit-stand version of the desk of FIG. 25 with the keyboard of FIG. 25 shown in accordance with another aspect of the current disclosure.

As shown in FIG. 27, the second portion 110*b* (shown in FIG. 26) of the desk 100 can support the aforementioned keyboard 82 proximate to a front end 103 (shown in FIG. 28) of the desk 100. As shown, a keyboard tray 84 can be secured to an underside of the desk 100 and to the desktop 110 and can itself hold a keyboard 85. Also as shown, the brackets 86 of the desk 100 can mount to a support panel 87. In some aspects, the support panel 87 can support material such as, for example and without limitation, sheet music for a musician playing the keyboard 82. In other aspects, the support panel 87 can support an electronic device (not shown) comprising a graphical user interface (GUI) display data such as, for example and without limitation, the sheet music in digital form or a program for production or post-production of audio data by the writing, recording, editing, and/or mixing of the audio data. Moreover, the desk 100 can comprise a CPU (central processing unit) support device 88, which can support a CPU 89 for powering the electronic device or other audio equipment such as the audio equipment supported by the desk 100.

Figure 29:
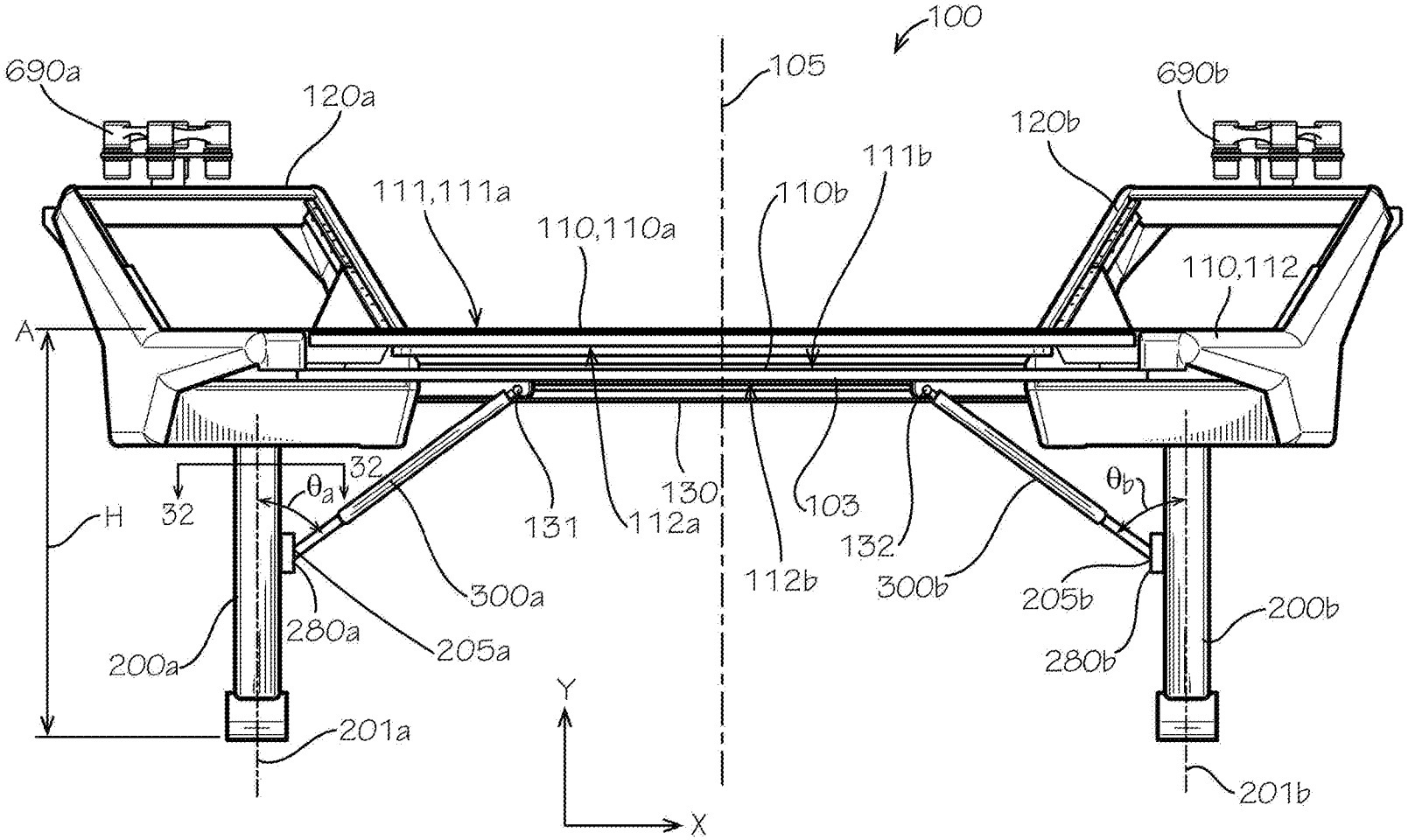
FIG. 29 is a front view of the desk of FIG. 28.
Figure 30:
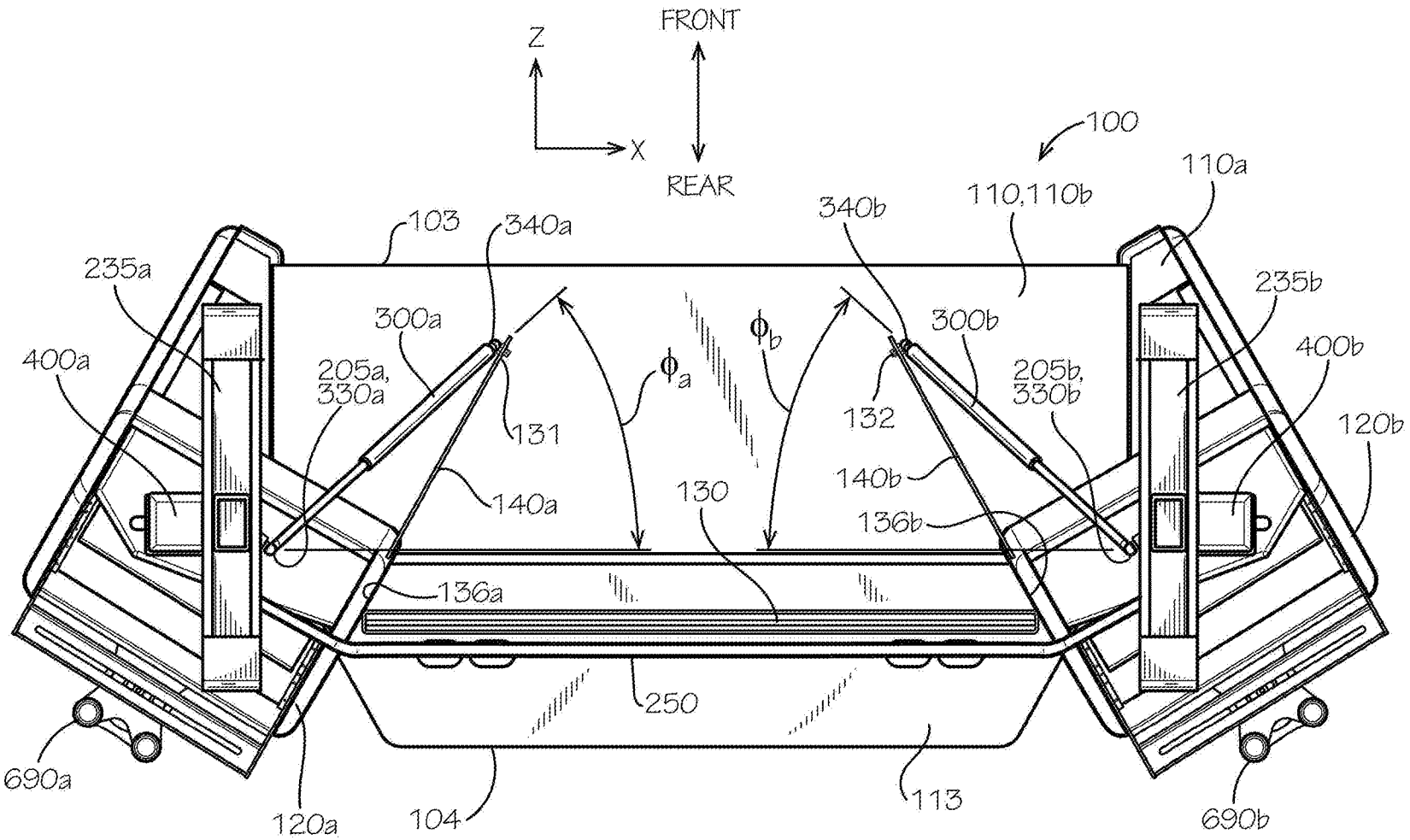
FIG. 30 is a bottom plan view of the desk of FIG. 28.

In some aspects, as described above and shown in FIG. 7, each of the gas springs 300*a,b* can be angled towards a rear end 104 (shown in FIG. 30) of the desktop 110 (i.e., in the negative Z-direction as shown in FIG. 30). In other aspects, as shown in FIG. 34, each of the gas springs 300*a,b* can be angled towards the front end 103 of the desk 100 (i.e., in the positive Z-direction as shown in FIG. 30). The respective joints 340*a,b* (shown in FIG. 30) of each of the gas springs 300*a,b* can thus be positioned proximate to the desktop 110 at the respective attachment points 131, 132 towards the front end 103 or the rear end 104 of the desktop 110 with respect to the joints 330*a,b* proximate to the legs 200*a,b*. More specifically, a fastener such as the connecting fastener 190 of each of the joints 340*a,b* can be secured to the respective brackets 140*a,b* shown. In some aspects, as shown, the brackets 140*a,b* can mount to an underside of the desktop 110 and can extend from a position proximate to the rear end 104 of the desktop 110 and towards a position proximate to the front end 103 of the desktop 110. In other aspects, the brackets 140*a,b* can extend from a position proximate to the front end 103 of the desktop 110 and towards a position proximate to the rear end 104 of the desktop 110. In other aspects, the brackets 140*a,b* can extend in another direction (such as partially or solely in the X-direction or the Y-direction shown in FIG. 27). As also shown, brackets 280*a,b* (280*b* shown in FIG. 29) can be used to fix the respective joints 330*a,b* (shown in FIG. 30) at the attachment points 205*a,b* (shown in FIG. 29).

Figure 28:
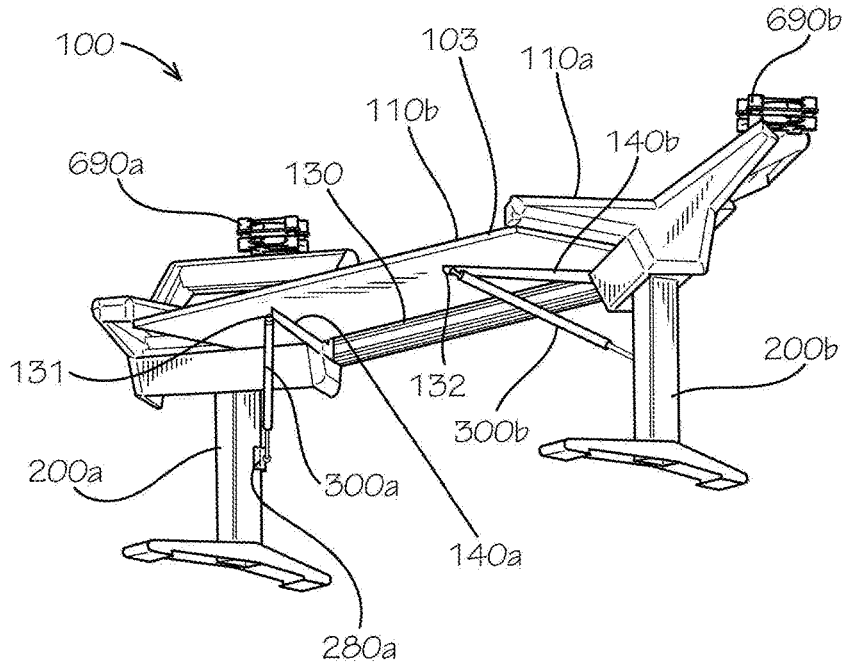
FIG. 28 is a front right bottom perspective view of the desk of FIG. 25 with the keyboard of FIG. 25 removed and the gas springs angled towards a front end of the desk in accordance with another aspect of the current disclosure.

FIG. 29 is a front view of the desk of FIG. 28. As noted above, the second portion 110*b* can be offset from the first portion 110*a* of the desktop 110. More specifically, the respective portions 110*a,b* of the desktop 110 can define upper surfaces 111*a,b* and lower surfaces 112*a,b*. Angles $\Theta_a$ and $\Theta_b$ can describe an angular position of each of the gas springs 300*a,b* with respect to the respective leg 200*a,b* in the X-Y plane shown. More specifically, each of the angles $\Theta_a$ and $\Theta_b$ can describe an angular position of the respective gas springs 300*a,b* with respect to a vertical orientation or the Y-direction defining, for example and without limitation, the axes 201*a,b*. In some aspects, the angles $\Theta_a$ and $\Theta_b$ can have the same angular measurement. In other aspects, the angles $\Theta_a$ and $\Theta_b$ can have different angular measurements.

FIG. 30 is a bottom plan view of the desk of FIG. 28. As shown, an inboard end of each of the brackets 140*a,b* can be positioned facing respective ends 136*a,b* of the cross rail 130. The gas springs 300*a,b* can be angled at respective angles $\phi_a$ and $\phi_b$ with respect to the X-direction of the desk 100. Angles $\phi_a$ and $\phi_b$ can describe an angular position of each of the gas springs 300*a,b* with respect to the X-direction shown. In some aspects, the angles $\phi_a$ and $\phi_b$ can have the same angular measurement. In other aspects, the angles $\phi_a$ and $\phi_b$ can have different angular measurements. As shown, the brackets 140*a,b* can themselves be angled with respect to the X-direction to position the joints 330*a,b* further inboard (or outboard) with respect to the ends 136*a,b* of the cross rail 130.

Figure 31:
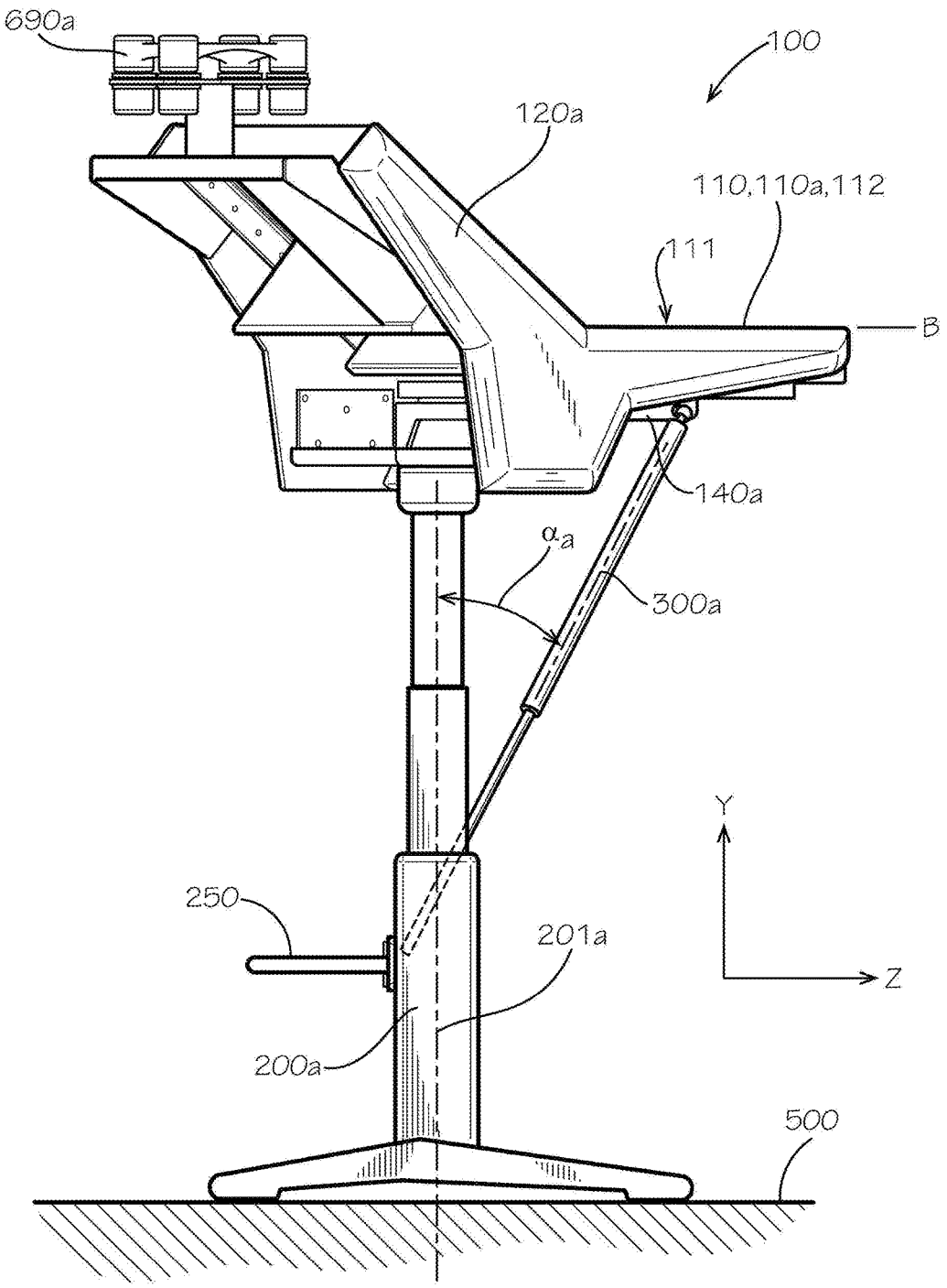
FIG. 31 is a side view of the desk of FIG. 28.

FIG. 31 is a side view of the desk of FIG. 28 with the first portion 110*a* of the desktop 110 raised to the upper position B. Angles $\alpha_a$ and $\alpha_b$ ($\alpha_b$ not shown) can describe an angular position of each of the gas springs 300*a,b* with respect to the respective leg 200*a,b*. More specifically, each of the angles $\alpha_a$ and $\alpha_b$ can describe an angular position of the respective gas springs 300*a,b* with respect to a vertical orientation or the Y-direction. In some aspects, the angles $\alpha_a$ and $\alpha_b$ can have the same angular measurement. In other aspects, the angles $\alpha_a$ and $\alpha_b$ can have different angular measurements.

In some aspects, in the lower position A or the upper position B or any position between the lower position A and the upper position B, any of the angles $\Theta_a$ and $\Theta_b$, the angles $\phi_a$ and $\phi_b$, or the angles $\alpha_a$ and $\alpha_b$ can measure in a range from and including about 5 degrees to about 85 degrees. In other aspects, any of the angles $\Theta_a$ and $\Theta_b$, the angles $\phi_a$ and $\phi_b$, or the angles $\alpha_a$ and $\alpha_b$ can measure in a range from and including about 10 degrees to about 80 degrees. In other aspects, any of the angles $\Theta_a$ and $\Theta_b$, the angles $\phi_a$ and $\phi_b$, or the angles $\alpha_a$ and $\alpha_b$ can measure in a range from and including about 20 degrees to about 70 degrees. In other aspects, any of the angles $\Theta_a$ and $\Theta_b$, the angles $\phi_a$ and $\phi_b$, or the angles $\alpha_a$ and $\alpha_b$ can measure in a range from and including about 30 degrees to about 60 degrees. In some aspects, with the respective joints 330*a,b*, 340*a,b* fixed with respect to the legs 200*a,b* and the desktop 110, any of the angles $\Theta_a$ and $\Theta_b$ or the angles $\phi_a$ and $\phi_b$ can decrease when the desktop 110 is raised from the lower position A to the upper position B.

In some aspects, with the respective joints 330*a,b*, 340*a,b* fixed with respect to the legs 200*a,b* and the desktop 110, any of the angles $\alpha_a$ and $\alpha_b$ can also increase or decrease when the desktop 110 is raised from the lower position A to the upper position B, at least when such raising of the desktop 110 causes movement of the joints 340*a,b* in either the X or Z directions, such as the case when the desktop 110 moves at least partially in the X or Z directions when raised such as when, for example and without limitation, the legs 200*a,b* or the axes 201*a,b* are angled with respect to the Y-direction.

In some aspects, in either the lower position A or the upper position B, any of the angles $\Theta_a$ and $\Theta_b$, the angles $\phi_a$ and $\phi_b$, or the angles $\alpha_a$ and $\alpha_b$ can measure about 30 degrees. In other aspects, in either the lower position A or the upper position B, any of the angles $\Theta_a$ and $\Theta_b$, the angles $\phi_a$ and $\phi_b$, or the angles $\alpha_a$ and $\alpha_b$ can measure about 45 degrees. In some aspects, in either the lower position A or the upper position B, any of the angles $\Theta_a$ and $\Theta_b$, the angles $\phi_a$ and $\phi_b$, or the angles $\alpha_a$ and $\alpha_b$ can measure about 60 degrees. When, in either the lower position A or the upper position B, any of the angles $\Theta_a$ and $\Theta_b$, the angles $\phi_a$ and $\phi_b$, or the angles $\alpha_a$ and $\alpha_b$ measures zero degrees, the force F acts in a direction perpendicular to the gas springs 300*a,b*, the force F may not be dampened by the gas springs 300*a,b* because the gas springs 300*a,b* do not extend even partially in a direction parallel to the direction in which the force F acts.

In some aspects, the gas springs 300*a,b* are effective in providing stability of the desk 100 through their dampening effect when one or more of the angles $\Theta_a$ and $\Theta_b$, the angles $\phi_a$ and $\phi_b$, or the angles $\alpha_a$ and $\alpha_b$ measure at least 25 to 30 degrees (i.e., the gas springs 300*a,b* can be angled at an angle of less than or equal to about 60 to about 65 degrees from the horizontal or X-direction or Z-direction, as applicable). In other aspects, the gas springs 300*a,b* are effective in providing stability of the desk 100 through their dampening effect when one or more of the angles $\Theta_a$ and $\Theta_b$, the angles $\phi_a$ and $\phi_b$, or the angles $\alpha_a$ and $\alpha_b$ measure at least 20 degrees (i.e., the gas springs 300*a,b* can be angled at an angle of less than or equal to about 70 degrees from the horizontal or X-direction or Z-direction, as applicable). In other aspects, the gas springs 300*a,b* are effective in providing stability of the desk 100 through their dampening effect when one or more of the angles $\Theta_a$ and $\Theta_b$, the angles $\phi_a$ and $\phi_b$, or the angles $\alpha_a$ and $\alpha_b$ measure at least 10 degrees (i.e., the gas springs 300*a,b* can be angled at an angle of less than or equal to about 80 degrees from the horizontal or X-direction or Z-direction, as applicable). In some aspects, the desk 100 will benefit more from the gas springs when raised above the lower position A due to the extension of the legs 200*a,b* and play in the various parts of the desk 100 that permits for increased movement (and therefore less stability) as the height H increases. In some aspects, the angles $\Theta_a$ and $\Theta_b$, the angles $\phi_a$ and $\phi_b$, or the angles $\alpha_a$ and $\alpha_b$ measure 90 degrees or greater than 90 degrees (i.e., the gas springs 300*a,b* can be aligned with the horizontal or X-direction or Z-direction, as applicable, or the gas springs can be angled down below the horizontal). In other aspects, the gas springs 300*a,b* can be positioned above the desktop 110.

In some aspects, the desired dampening effect for increased stability of the desk 100 can be achieved whenever the components of the desk such as the leg 200*a,b*, the desktop 110, and the gas spring 300*a,b* form a triangular "truss" shape naturally resisting movement (as a triangular truss resists movement and thus collapse in a structural member of a bridge, for example). In the case of the gas springs 300*a,b*, however, allows controlled or dampened movement in at least one of the three "legs" of the triangular structure created. In other aspects, the structured need not resemble a triangular shape and still provide an effective dampening effect.

In some aspects, the gas springs 300*a,b* can be angled with respect to the legs 200*a,b* in any of the X-direction, the Y-direction, or the Z-direction. Depending on how the weight of the desk 100—including any equipment the desk 100 supports—is concentrated, joints such as the joints 330*a,b*, 340*a,b* of the gas springs 300*a,b* can be distributed in an area proximate to those weight concentrations.

In some aspects as shown, the desk 100 can comprise a pair of gas springs 300*a,b*. In other aspects, the desk 100 can comprise only a single gas spring 300*a,b*. In other aspects, the desk 100 can comprise more than two gas springs 300*a,b*.

Figure 9:
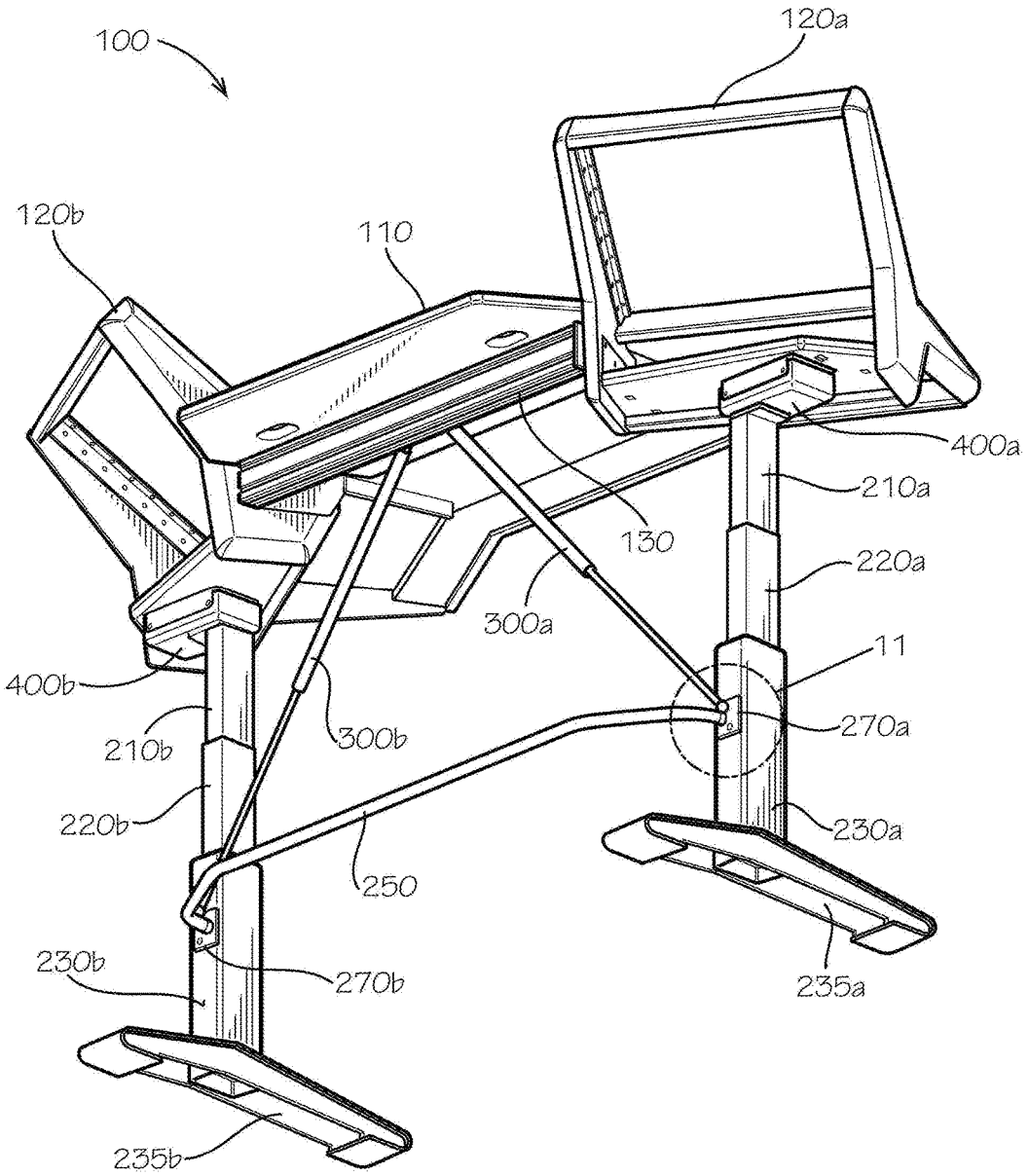
FIG. 9 is a rear bottom perspective view of the desk of FIG. 3.
Figure 10:
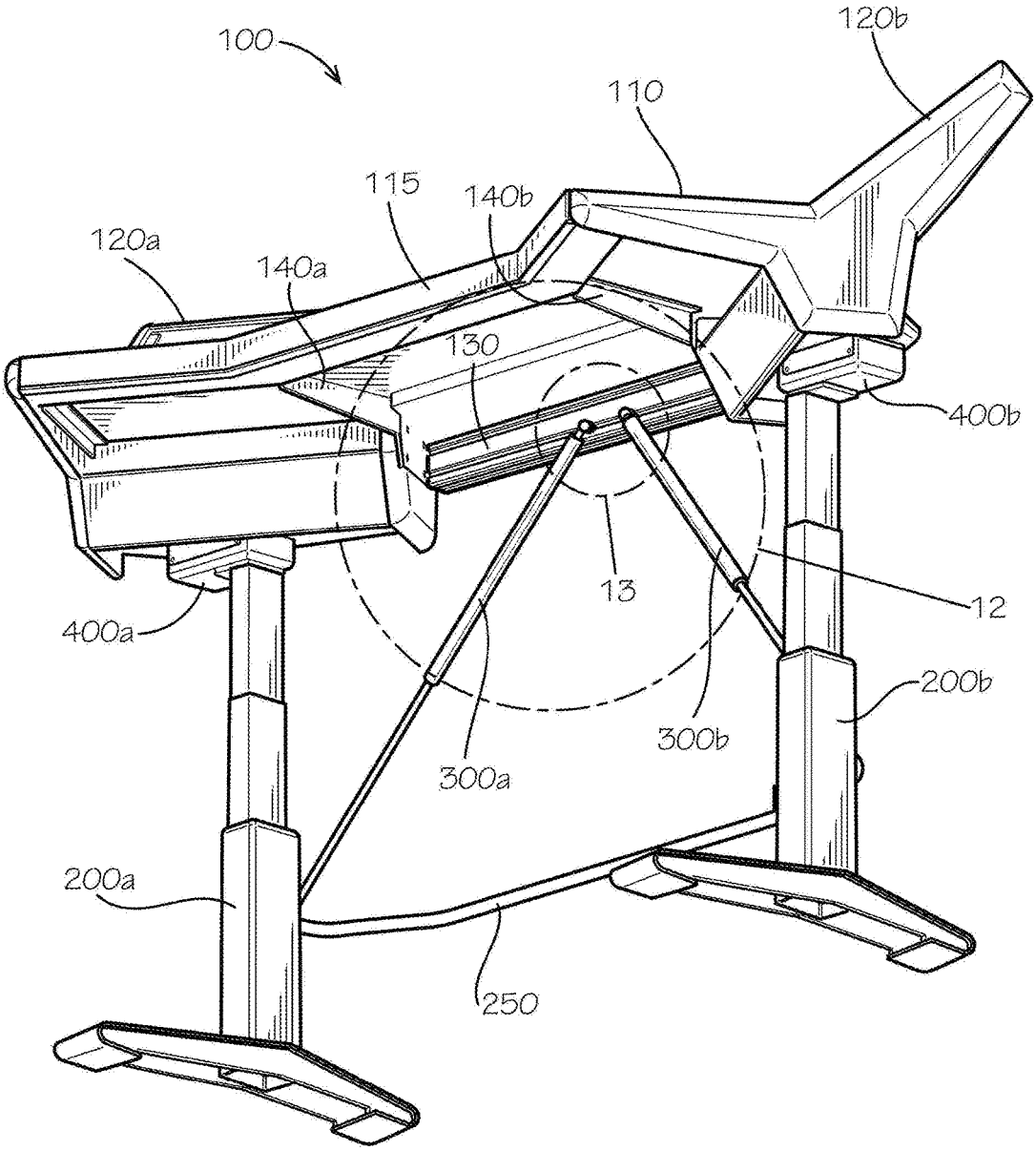
FIG. 10 is a front bottom perspective view of the desk of FIG. 3.
Figure 32:
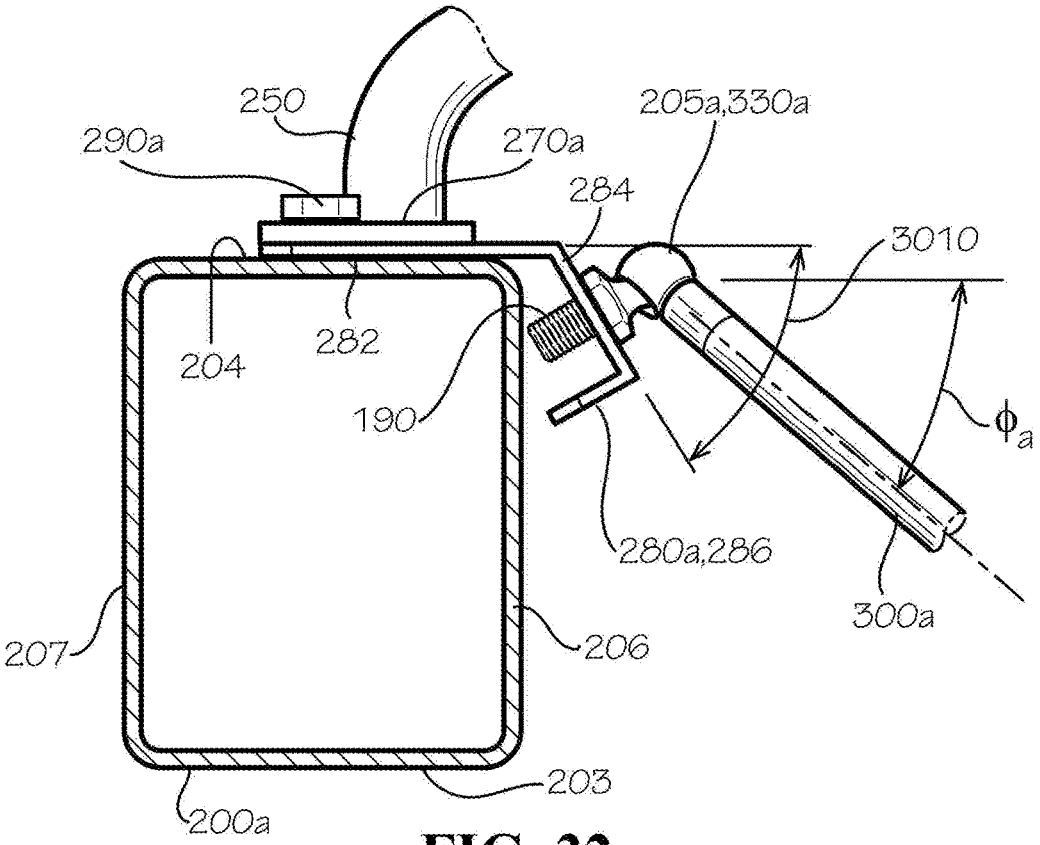
FIG. 32 is a sectional view of the desk of FIG. 28 taken from line 32-32 of FIG. 29 comprising a leg stabilizer and a bracket in accordance with another aspect of the current disclosure.

As shown in FIG. 32, the leg stabilizer 250 and the gas springs 300*a,b* (300*b* shown in FIG. 27) can be secured to the leg 200*a,b* (200*b* shown in FIG. 27). A member of the leg 200 can define a front side 203, a rear side 204, an inboard side 206, and an outboard side 207. More specifically, the leg stabilizer 250 can extend from the aforementioned bracket 270*a* (and similarly from the bracket 270*b* at an opposite end of the desk 100), which can secured to the rear side 204 of the leg 200*a,b*. Instead of being secured to the brackets 270*a,b* as shown in FIG. 9, the gas springs 300*a,b* can be secured to the brackets 280*a,b* (280*b* shown in FIG. 29). Each of the brackets 280*a,b* can comprise a first portion 282, a second portion 284, which can be angled with respect to the first portion 282 by an angle 3010, and a third portion 286, which can be angled with respect to the second portion 284. In other aspects, any of the brackets 270*a,b* or the brackets 280*a,b* can be positioned to the front side 203, the inboard side 206, or the outboard side 207. As shown, the second portion 284 and the third portion 286 of the bracket 280*a* can face the inboard side 206 of the leg 200*a* to facilitate positioning of the joints 330*a,b* (330*b* shown in FIG. 30) such that, for example and without limitation, the gas springs 300*a,b* can freely extend or retract in any position of the desk 100 without interference with the bracket 280*a,b*, the leg 200*a,b*, or any other portion of the desk 100. As shown, the bracket 270*a* and the bracket 280*a,b* can be secured to the leg 200 with the fastener 290*a*.

Figure 33:
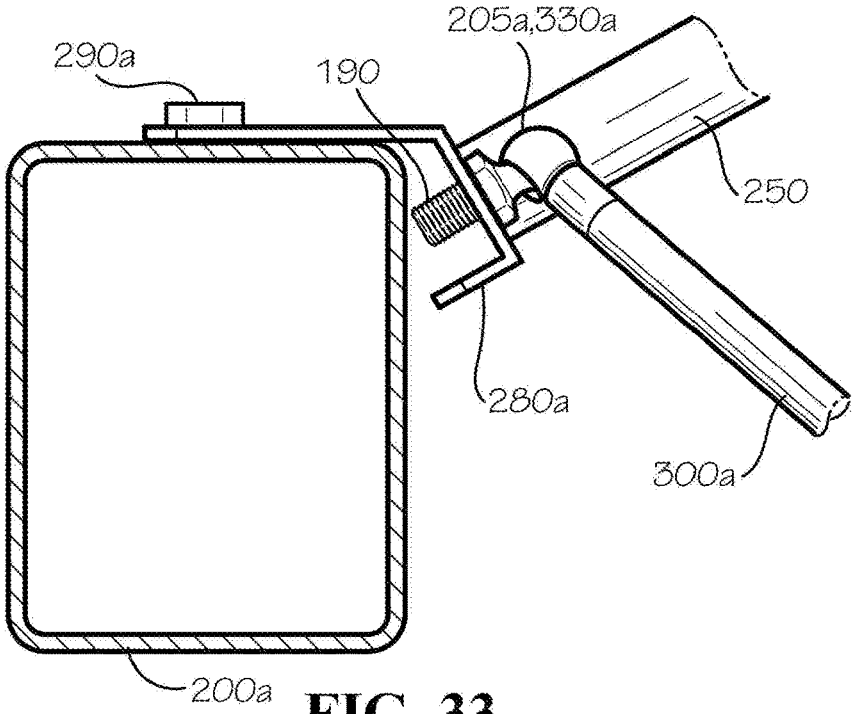
FIG. 33 is a sectional view of the desk of FIG. 28 comprising a leg stabilizer and a bracket in accordance with another aspect of the current disclosure combining the bracket of the leg stabilizer with the bracket to which the gas spring is secured.

As shown in FIG. 33, the leg stabilizer 250 can extend from the bracket 280*a* (and similarly from the bracket 280*b* at an opposite end of the desk 100 as shown in FIG. 29). As shown, in some aspects the leg stabilizer 250 can be angled with respect to the X-direction (shown in FIG. 30). In other aspects, the leg stabilizer 250 need not be angled with respect to the X-direction. As shown, the bracket 280*a,b* can be secured to the leg 200 with the aforementioned fastener 290*a*.

One should note that conditional language, such as, among others, "can," "could," "might," or "may," unless specifically stated otherwise, or otherwise understood within the context as used, is generally intended to convey that certain aspects include, while other aspects do not include, certain features, elements and/or steps. Thus, such conditional language is not generally intended to imply that features, elements and/or steps are in any way required for one or more particular aspects or that one or more particular aspects necessarily comprise logic for deciding, with or without user input or prompting, whether these features, elements and/or steps are included or are to be performed in any particular aspect.

It should be emphasized that the above-described aspects are merely possible examples of implementations, merely set forth for a clear understanding of the principles of the present disclosure. Any process descriptions or blocks in flow diagrams should be understood as representing modules, segments, or portions of code which comprise one or more executable instructions for implementing specific logical functions or steps in the process, and alternate implementations are included in which functions may not be included or executed at all, may be executed out of order from that shown or discussed, including substantially concurrently or in reverse order, depending on the functionality involved, as would be understood by those reasonably skilled in the art of the present disclosure. Many variations and modifications may be made to the above-described aspect(s) without departing substantially from the spirit and principles of the present disclosure. Further, the scope of the present disclosure is intended to cover any and all combinations and sub-combinations of all elements, features, and aspects discussed above. All such modifications and variations are intended to be included herein within the scope of the present disclosure, and all possible claims to individual aspects or combinations of elements or steps are intended to be supported by the present disclosure.

That which is claimed is:

1. A desk comprising:

a desktop defining a height configured to be adjusted between a lower position and an upper position;

a leg comprising an attachment portion and a foot portion, the attachment portion of the leg secured to the desktop and extending away from the desktop, the attachment portion of the leg configured to move with respect to the foot portion of the leg along an axis of the leg to adjust a height of the desktop about and between the lower position and the upper position, the foot portion of the leg defining a bottom end of the desk; and a gas spring extending from the leg to the desktop, the gas spring angled with respect to the leg by an angle of at least 5 degrees and with respect to the desktop by an angle of at least 5 degrees, the gas spring configured to dampen movement of the desk when a force comprising a horizontal component is applied to an edge of the desktop when the desktop is in the upper position.

2. The desk of claim 1, wherein the attachment portion of the leg is movable with respect to the foot portion of the leg in a substantially vertical direction.

3. The desk of claim 2, wherein the leg comprises a telescoping feature configured to adjust the height of the desktop.

4. The desk of claim 1, wherein the gas spring is angled with respect to the leg by an angle of between about 10 degrees and about 80 degrees in at least one direction.

5. The desk of claim 1, wherein the gas spring is angled with respect to the leg by an angle of between about 10 degrees and about 80 degrees in at least two directions.

6. The desk of claim 1, wherein the gas spring is angled with respect to the leg by an angle of between about 10 degrees and about 80 degrees in three directions.

7. The desk of claim 1, wherein a joint of the gas spring is secured to the foot portion of the leg, an angle of the gas spring measured with respect to the leg varying with the height of the desktop.

8. The desk of claim 1, wherein the leg is a first leg, the desk further comprising a second leg comprising an attachment portion and a foot portion, the attachment portion of the second leg secured to the desktop and extending away from the desktop, the attachment portion of the second leg configured to move with respect to the foot portion of the second leg along an axis of the second leg, the first leg and the second leg thereby configured in combination to adjust the height of the desktop about and between the lower position and the upper position, the first leg and the second leg defining an open space on the floor surface therebetween, the open space configured to receive a body of a user of the desk when the user is sitting or standing at any horizontal position between the first leg and the second leg.

9. The desk of claim 8, further comprising a leg stabilizer extending from the first leg to the second leg.

10. The desk of claim 1, wherein a secondary portion of the desktop is offset in a vertical direction with respect to a main portion of the desktop.

11. The desk of claim 1, wherein the gas spring is secured to each of the leg and the desktop without tools.

12. The desk of claim 11, wherein the gas spring is secured to each of the leg and the desktop with a ball and socket joint, a joint of the gas spring defining a socket and the desktop defining a ball.

13. A desk comprising:

a desktop;

a leg comprising an attachment portion and a foot portion, the attachment portion of the leg secured to the desktop and extending away from the desktop, the foot portion of the leg defining a bottom end of the desk, a position of the desktop fixed with respect to the foot portion of the leg; and a gas spring connecting the leg to the desktop, the gas spring angled with respect to the leg by an angle of at least 5 degrees and with respect to the desktop by an angle of at least 5 degrees when viewed from a front of the desk, the gas spring also angled with respect to a vertical direction of the desk by an angle of at least 5 degrees towards the front or away from the front of the desk, the gas spring configured to dampen movement of the desk when a force comprising a horizontal component is applied to an edge of the desktop.

14. The desk of claim 13, wherein the gas spring is angled with respect to the leg by an angle of between about 10 degrees and about 80 degrees in at least one direction.

15. The desk of claim 13, wherein the gas spring is angled with respect to the leg by an angle of between about 10 degrees and about 80 degrees in at least two directions.

16. The desk of claim 13, wherein the leg is a first leg, the desk further comprising a second leg comprising an attachment portion and a foot portion, the attachment portion of the second leg secured to the desktop and extending away from the desktop.

17. The desk of claim 13, wherein the gas spring is secured to each of the leg and the desktop without tools.

18. A method of assembling a desk, the method comprising:

attaching a first joint of a first gas spring of the desk to a first attachment point on a desktop;

attaching a second joint of the first gas spring to an attachment point on a first leg, the first leg secured to the desktop and extending away from the desktop, the first leg comprising an attachment portion and a foot portion, the foot portion of the first leg defining a bottom end of the desk;

attaching a first joint of a second gas spring of the desk to a second attachment point on the desktop; and attaching a second joint of the second gas spring to an attachment point on a second leg, the second leg secured to the desktop and extending away from the desktop, the second leg comprising an attachment portion and a foot portion, the foot portion of the second leg defining a bottom end of the desk; and stabilizing the desk with each of the first gas spring and the second gas spring by dampening the movement of the desktop with respect to the first leg and the second leg with the first gas spring and the second gas spring when a force is applied to the desk;

wherein after attaching the first gas spring to the desktop and to the first leg the first gas spring is angled with respect to the first leg by an angle of at least 5 degrees and with respect to the desktop by an angle of at least 5 degrees; and after attaching the second gas spring to the desktop and to the second leg the second gas spring is angled with respect to the second leg by an angle of at least 5 degrees and with respect to the desktop by an angle of at least 5 degrees, each of the first gas spring and the second gas spring configured to dampen movement of the desk when a force comprising a horizontal component is applied to an edge of the desktop.

19. The method of claim 18, further comprising attaching a leg stabilizer to the first leg and to the second leg, the leg stabilizer extending from the first leg to the second leg and fixing a distance therebetween.

20. The method of claim 18, wherein the desktop defines a height, the method further comprising:

adjusting each of the first leg and the second leg in combination to raise the height of the desktop from a lower position to an upper position; and stabilizing the desk in the upper position, the first gas spring remaining angled with respect to the first leg by an angle of at least 5 degrees and with respect to the desktop by an angle of at least 5 degrees and the second gas spring remaining angled with respect to the second leg by an angle of at least 5 degrees and with respect to the desktop by an angle of at least 5 degrees.

* * * * *